US005819714A

United States Patent [19]

Bush et al.

[11] Patent Number: 5,819,714

[45] **Date of Patent: *Oct. 13, 1998**

[54] ADAPTIVE TRANSIENT FUEL COMPENSATION FOR A SPARK IGNITED ENGINE

[75] Inventors: Kevin J. Bush, Northville; Darren A. Schumacher, Ypsilanti, both of Mich.

[73] Assignee: Motorola Inc., Schaumburg, Ill.

[ * ] Notice: The term of this patent shall not extend beyond the expiration date of Pat. No. 5,642,722.

[21] Appl. No.: 636,729

[22] Filed: Apr. 19, 1996

Related U.S. Application Data

[63] Continuation-in-part of Ser. No. 550,442, Oct. 30, 1995, Pat. No. 5,642,722.

[51] Int. Cl.[6] ..... F02D 41/14

[52] U.S. Cl. ..... 123/673; 123/674; 123/480; 701/104

[58] Field of Search ..... 123/673–675, 123/478, 480, 492, 493; 364/431.05; 701/103, 104

[56] References Cited

U.S. PATENT DOCUMENTS

| | | | |
|---|---|---|---|
| 4,357,923 | 11/1982 | Hideg | 123/492 |
| 4,388,906 | 6/1983 | Sugiyama et al. | 123/492 |
| 4,481,928 | 11/1984 | Takimoto et al. | 123/492 |
| 4,939,658 | 7/1990 | Sekozawa et al. | 364/431.06 |
| 5,448,978 | 9/1995 | Hasegawa et al. | 123/480 |

FOREIGN PATENT DOCUMENTS

| | | |
|---|---|---|
| 0 152 019 | 8/1985 | European Pat. Off. . |
| 59-3136 | 1/1984 | Japan . |
| 1-200040 | 8/1989 | Japan . |

OTHER PUBLICATIONS

Real Time Engine Control Using STR in Feedback System by Maki, Akazaki, Hasegawa, Komoriya, Nishimura and Hirota–1995 Honda R&D Co., Ltd.

Adaptive Air–Fuel Ratio Control of a Spark–Ignition Engine by Ault, Jones, Powell and Franklin—Stanford University, 1994.

An Adaptive Fuel Injection Control with Internal Model in Automotive Engines by Inagaki, Ohata and Inoue—Toyota Motor Corporation Technical Center, Japan, Nov., 1990.

*Primary Examiner*—Andrew M. Dolinar
*Attorney, Agent, or Firm*—Nicholas C. Hopman

[57] ABSTRACT

A method and system for adaptive transient fuel compensation in a cylinder of a multi-cylinder engine estimates fuel puddle dynamics for the cylinder by determining parameters of a wall-wetting model every engine cycle of the multi-cylinder engine. Fuel delivery to the cylinder is adjusted dependent on the estimated fuel puddle dynamics.

2 Claims, 10 Drawing Sheets

$m_f$: FUEL FILM MASS
$m_{dep}$: FUEL MASS DEPOSITED IN FILM
$m_v$: FUEL VAPOR FROM FILM
$m_i$: FUEL MASS INJECTED
$m_c$: FUEL MASS ENTERING CYLINDER
c: FUEL FRACTION PARAMETER
$b_v$: FUEL FILM VAPORIZATION PARAMETER
k: ENGINE CYCLE INDEX $$m_f(k) = m_f(k-1) + m_{dep}(k) - m_v(k)$$
$$m_{dep}(k) = c\,m_i(k)$$
$$m_v(k+1) = b_v m_f(k)$$
$$m_c(k) = (1-c)m_i(k) + m_v(k)$$

ADAPTIVE TRANSIENT FUEL COMPENSATION FOR A SPARK IGNITED ENGINE

This application is a continuation-in-part of an earlier filed application Ser. No. 08/550,442 filed Oct. 30, 1995, now U.S. Pat. No. 5,642,722.

FIELD OF THE INVENTION

This invention is generally directed to the field of engine control, and specifically for control of air/fuel ratio in a spark ignited engine by adaptively adjusting fuel delivery dependent on a measurement of certain fuel delivery system dynamic behavior.

BACKGROUND OF THE INVENTION

Contemporary spark ignited internal combustion engines are operated by electronics to control, among other things, emissions of pollutants into the atmosphere. Environmental legislation continually requires stricter limitations on emissions in automotive applications. To reduce automotive emissions in a spark ignited internal combustion engine precise control of combustion air/fuel ratio is necessary. This is usually done by metering a precisely controlled amount of fuel based on a measured or inferred air charge mass ingested into the engine. Many control schemes currently control fuel but with less accuracy than necessary. Precise control is difficult because of a deposit, and subsequent evaporation of the deposit, of fuel on the walls of an intake manifold and on intake valves of the engine. This phenomena is sometimes referred to as wall-wetting. To achieve accurate control of the fuel delivered for combustion fuel behavior associated with wall-wetting must be accurately compensated.

Wall-wetting behavior is dynamic and has been characterized by two parameters corresponding to a fraction of injected fuel that is deposited into a film or puddle on a backside of the intake valves and the walls of the intake manifold, and a fraction of the fuel film evaporating from the film between one engine cycle and the next. These two parameters vary with engine operating conditions such as engine speed, load, and temperature. These two parameters also vary over time with engine age, engine intake valve deposits and fuel composition, making it difficult to compensate for wall-wetting with consistent accuracy. Furthermore, during nontrivial transients, the wall-wetting parameters can vary rapidly with rapidly varying operating conditions.

Some prior art schemes that attempt to compensate for the above-introduced wall-wetting behavior exhibit a large lean excursion while opening the throttle (acceleration), and a large rich excursion while closing the throttle because they insufficiently compensate for the wall-wetting behavior. Furthermore, some prior art systems overcompensate the transient fuel dynamics causing an excessively rich mixture during acceleration. Both under-compensation and over-compensation fuel control errors are due to inaccurate fuel compensation when the engine dynamic parameters differ from predetermined values. In most of these prior art schemes wall-wetting parameters are experimentally mapped as functions of engine speed and engine load and stored in tables for use in controlling an engine. Mapping wall-wetting parameters is a testing intensive and expensive process. The mapping is usually performed on a single prototype engine that may exhibit behavior not representative of every mass-produced engine and is then applied to mass produced engines. Furthermore, the tables are typically constructed for steady-state operating conditions and a warm engine, making these schemes inaccurate for transient and cold engine operating conditions. Often the prior art schemes rely on ad-hoc/experimentally determined temperature correction factors to compensate for temperature effects, with only limited success. Also, with the long term aging effects such as the accumulation of intake valve deposits, the control accuracy and hence the emissions of the engine deteriorate significantly with age. Emissions deterioration as the engine ages is now an important problem since the 1990 amendments to the Clean Air Act increased the emissions durability requirements to 100,000 miles.

Other (adaptive) prior art schemes address the time-varying nature of the wall-wetting dynamics. These prior art schemes often involve nonlinear programming and parameter space search techniques that are prohibitively computationally intensive and relatively slow to converge in a real time application. The best known prior art schemes take about 40 seconds to converge, which is unacceptably long for application in an automotive environment. Furthermore, these prior art schemes rely on steady-state engine operation and do not adjust for fuel behavior on a cycle-by-cycle basis resulting in poor transient behavior. These long convergence times and the inability to adapt on a cycle-by-cycle basis result in an adaptive system that is slow to respond to changing engine dynamics. Slow response to rapidly changing engine dynamics creates tracking errors that result in unacceptable deviations from a stoichiometric air/fuel ratio during engine transients, and increased emissions.

In summary, prior art mapped fuel compensation schemes do not accurately take time varying engine operating conditions such as engine temperature, engine age, engine valve deposits and fuel composition into account. Furthermore, adaptive prior art fuel compensator schemes are computationally intensive and have inaccurate transient behavior. More accurate transient and cold engine fuel control is necessary in order to meet future emissions requirements. Therefore, what is needed is a more accurate fuel compensation approach for a spark ignition engine that automatically adjusts for time varying fuel delivery dynamic behavior due to causes such as engine operating conditions, engine age, and fuel composition without requiring excessive computational resources.

SUMMARY OF THE INVENTION

A method and system for adaptive transient fuel compensation in a cylinder of a multi-cylinder engine estimates fuel puddle dynamics for the cylinder by determining parameters of a wall-wetting dynamic model every engine cycle of the multi-cylinder engine. Fuel delivery to the cylinder is adjusted dependent on the estimated fuel puddle dynamics.

By implementing the essential structure just described a more accurate fuel compensation approach for a spark ignition engine that accounts for time varying fuel injection dynamic behavior due to causes such as engine operating conditions, engine age, and fuel composition without requiring excessive computational resources can be constructed. The structural approach detailed below identifies wall-wetting parameters corresponding to an amount of fuel deposited, and a subsequent amount evaporated per engine cycle, on walls of an intake manifold and on intake valves of the engine on a (combustion) cycle-by-cycle basis dependent on fuel injected, a measurement of fuel/air ratio in an exhaust stream, and an air charge estimate, and uses this information to accurately compensate for the wall-wetting dynamics by controlling delivery of fuel to the engine. The goals of this novel compensation method are to reduce the normalized air/fuel ratio (lambda) deviations away from stoichiometry (lambda equals one) in the exhaust stream which occur during engine transients at both warm and cold engine operating conditions, using a computationally efficient approach that can be easily implemented, while achieving fast convergence by exploiting a model structure.

DETAILED DESCRIPTION OF A PREFERRED EMBODIMENT

Before detailing specific structures for constructing the preferred embodiment a little theoretical background would be useful to fully appreciate the advantages and alternative structures.

Model Description

Figure 1:
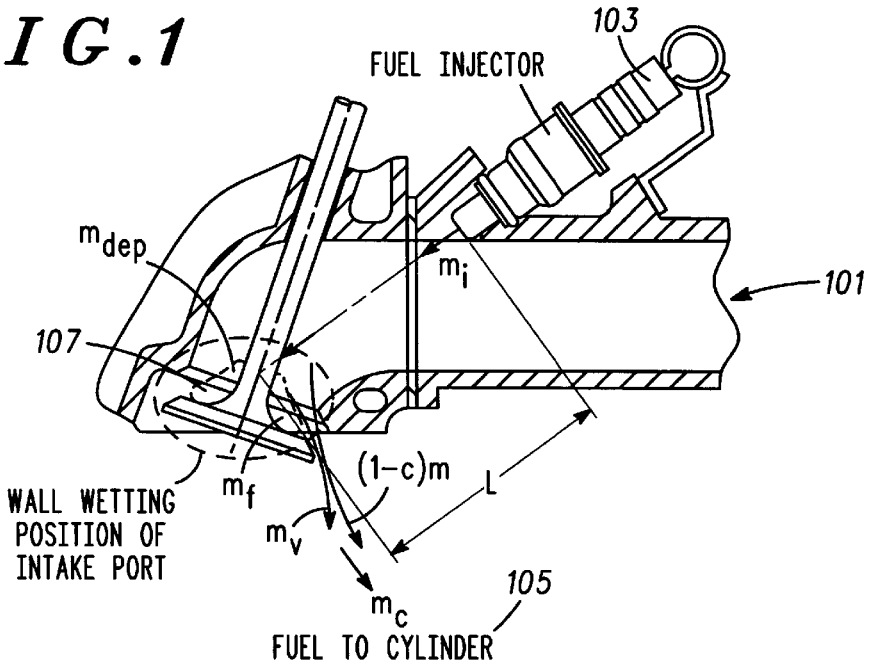
FIG. 1 is a schematic diagram of a fuel film (wall-wetting) model.

FIG. 1 is a schematic diagram of a fuel film (wall-wetting) model useful for representing an amount of fuel deposited, and a subsequent amount evaporated per engine cycle, on walls of an intake manifold and on intake valves of the engine. The illustrated model is characterized by two parameters, C and $b_v$. A parameter C denotes a fraction of fuel from a given fuel injection event that adheres to (puddles on) the manifold walls, intake valves, or other structure preventing the full fuel charge from reaching the cylinder's combustion chamber. Note that if C is equal to one, none of the fuel injected feeds through directly to the fuel charge in that cylinder for that engine cycle. A second parameter $b_v$, denotes a mass fraction of the puddle that evaporates during a given engine cycle. The illustrated model has an advantage of being based in the crankshaft angle domain, which means that a sampling rate does not appear in the system dynamics.

Adaptive Feedforward Control Strategy

An essential approach of a control strategy employed here is adaptive feedforward control. By identifying the wall-wetting model parameters C and $b_v$ on-line, on an engine cycle-by-cycle basis, an amount of fuel injected can be modified so as to compensate for the effects of wall-wetting on the combustion fuel charge, making it possible to maintain a stoichiometric air/fuel ratio in the cylinder for combustion even under transient engine operating conditions, unaffected by engine aging, fuel composition, and engine temperature. The identified parameters, C and $b_v$, allow the compensation tuning to be adjusted by real time calculations to match the time varying engine dynamic behavior.

The wall-wetting compensation taught here uses a feedforward compensation approach. The amount of desired fuel to match an estimated air charge is input to the compensation method to calculate an amount of fuel to inject to a cylinder in an immediate, proactive control action. Preferably, feedforward control is used for transient compensation because the transport and sensing delays of the control system limit the bandwidth of the error-driven feedback loop, making adaptive cycle-by-cycle feedback compensation ineffective for fast transient changes in charge air mass. A schematic of the control strategy is shown in FIG. 2.

Figure 2:
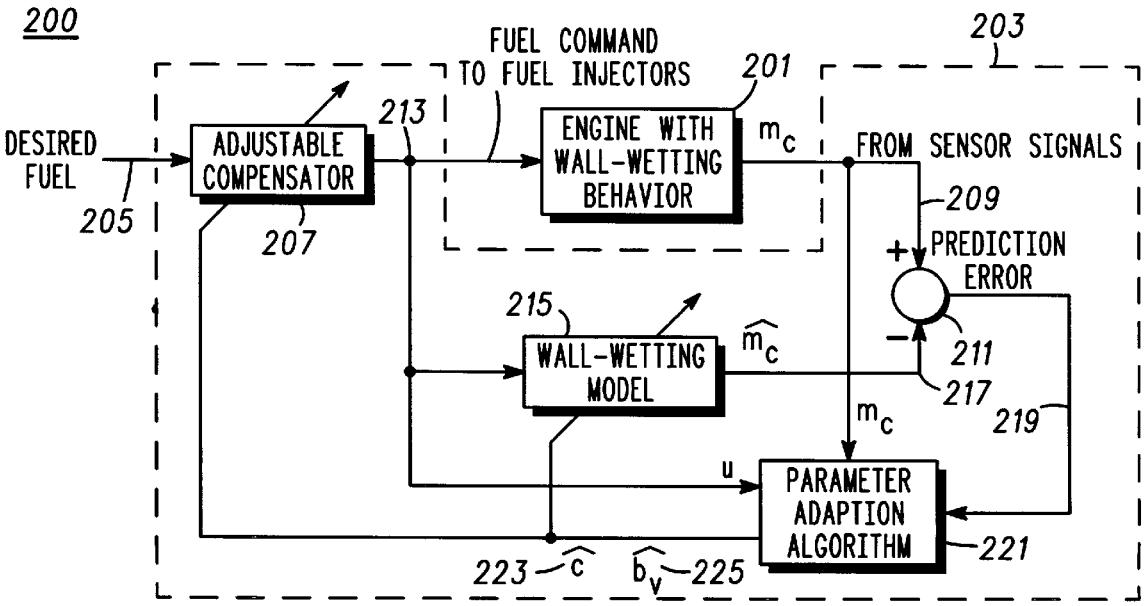
FIG. 2 is a schematic diagram of an adaptive controller in accordance with a preferred embodiment of the invention.

FIG. 2 is a schematic diagram of an adaptive controller in accordance with the preferred embodiment of the invention. An adaptive controller 203 is characterized by three components, an adjustable compensator 207, a wall-wetting model 215, and a parameter adaptation algorithm 221. The adjustable compensator 207 receives estimates of a parameter C 223 and of a parameter $b_v$ 225 directly from the parameter adaptation algorithm 221, and adjusts fuel injected 213 dependent on the parameter estimates 223 and 225 and a desired fuel demand 205.

The adjustable compensator 207 is a lead compensator 207, that cancels wall-wetting dynamics 201.

Other possible compensators, such as those designed using H-infinity or mu-synthesis or observer feedback control strategies could be employed as well. The wall-wetting model 215 is used to estimate the value of the system output 209 based on the estimates 223 and 225, respectively of a parameter C and of a parameter $b_v$ from a previous engine cycle. The wall-wetting model 215 characteristic of the preferred embodiment of this invention is detailed in FIG. 1. Other wall-wetting models could be employed in similar fashion, including continuous time models, discrete models with varying sample rates, and continuous or discrete time models including higher order dynamic effects. The estimated value of the system output 217 is then subtracted from the measured system output 209 for the current cycle in order to obtain a prediction error 219. The prediction error 219 is then utilized by the parameter adaptation algorithm 221 in order to update the estimates 223 and 225, respectively of a parameter C and a parameter $b_v$. The parameter adaptation algorithm employed 221 in the preferred embodiment of this invention is a recursive Linear Quadratic algorithm, but other identification algorithms based on Extended Kalman Filter Theory, H-Infinity, Neural Nets, Fuzzy Logic, or Non-quadratic Cost Functions could be similarly employed.

As mentioned earlier the improved approach identifies the wall-wetting parameters on every firing cycle during transients and during the warm-up period of a cold engine. Identification is based only on the fuel injected, an air charge estimate, and a UEGO (Universal Exhaust Gas Oxygen) or other linear response exhaust gas sensor reading of the fuel/air equivalence ratio. No parameter maps are necessary and it is not necessary for the engine to be in a steady-state or at idle to get correct results. The parameters identified by the algorithm during the previous engine cycle are used to estimate the fuel burned during the current engine cycle, which is compared to the fuel burned during the current engine combustion cycle based on the UEGO sensor measurement. The result is used by the adaptation algorithm to update the parameter estimates. The updated estimates are then used by a feedforward compensator to adaptively eliminate wall-wetting effects.

Rewriting the model equations introduced in FIG. 1 and taking the Z transform gives the transfer function of the fuel film model:

$$G_f(z) = \frac{m_c(z)}{m_i(z)} = \frac{(1-c) + (b_v + c - 1)z^{-1}}{1 - (1 - b_v)z^{-1}} \tag{1}$$

These are the wall-wetting dynamics that need to be compensated during an engine transient in order to deliver the desired amount of fuel to the cylinder for combustion.

Parameter Identification

One approach to compensating for the wall-wetting dynamics would be to identify the transfer function coefficients from input/output data and directly invert these dynamics using Equation (1). However, this approach requires large data sets, making it computationally impractical. A set of transfer function parameters may not imply a unique solution for the parameters of the physical model. Other approaches have been proposed which identify the physical wall-wetting model parameters, but these have typically involved large data sets and computationally intensive search algorithms involving nonlinear programming techniques and/or Gauss-Newton searches. It is the goal of this compensation method to identify the physical wall-wetting model parameters directly on a cycle-by-cycle basis for real-time tracking of the system dynamics, and to use these parameters with Equation (1) to compensate the injected fuel. Furthermore, the real time calculations must be accomplished within the practical constraints of current embedded micro-controllers used in automotive engine controls.

In order to facilitate the identification of the wall-wetting parameters directly, the transfer function given by Equation (1) can be rewritten in state-space form as:

$$x(k)=(1-b_v)\times(k-1)+cu(k)$$

$$y(k)=b_v\times(k-1)+(1-c)u(k) \tag{2}$$

where x(k) is the film state, representing the mass of the fuel film, y(k)is the fuel burned and k is the engine cycle index. Note that if C is equal to one, then the control input does not appear in the output and the system has a pure delay. The film state at the kth cycle is obtained by solving these equations for x(k−1) and equating the results:

$$x(k) = (y(k) - u(k) + cu(k))((1 - b_v)/b_v) + cu(k) \tag{3}$$

Shifting this result by one cycle and substituting into the output equation from Equation (2) allows one to solve for y(k) in terms of the previous system inputs and outputs:

$$y(k)=(1-b_v)y(k-1)+(1-c)u(k)+(b_v1+c)u(k-1) \tag{4}$$

Moving all terms not multiplied by the wall-wetting parameters to the left hand side of Equation (4) yields:

$$y(k)-y(k-1)-u(k)+u(k-1)=b_v(u(k-1)-y(k-1))+c(u(k-1)-u(k)) \tag{5}$$

which can be rewritten in a more compact form as:

$$\bar{y}(k)=h(k)\hat{p}(k) \tag{6}$$

where $\bar{p}=[b_v c]'$, where the cycle-by-cycle dependence of the wall-wetting parameters is now included in Equation 6. By rewriting the system equations in this way, the new output, $\bar{y}$, is linear in the wall-wetting model parameters, while preserving the structure of the dynamics (how the variables are related), enabling the use of linear identification techniques to identify c and $b_v$ directly.

The best practical estimates of the wall-wetting model parameters can be identified by finding the solution that minimizes the following Linear Quadratic cost function:

$$J(\hat{p})=\tfrac{1}{2}\{e'(k)V^{-1}e(k)+(\hat{p}(k)-\hat{p}(k-1))'\bar{P}^{-1}(\hat{p}(k)-\hat{p}(k-1))\} \tag{7}$$

where $e(k)=\bar{y}(k)-h(k)\hat{p}(k)$ is the estimation error based on current parameter estimates, and V and $\bar{P}$ are the weighted covariance of the measurement signal $\bar{y}(k)$, and the weighted covariances of the parameter estimates, respectively. That is, $V=W_1V^*$, where $W_1$ is a weighting factor applied to the covariance of the measurement noise $V^*$, and $\bar{P}=W_2P^*$, where $W_2$ is a weighting factor applied to the covariance of the estimates $P^*$. Henceforward, V and $\bar{P}$ will simply be referred to as the measurement and parameter estimate covariances.

In general, $\bar{y}$, h, $\hat{p}$, and e are vectors, V and $\bar{P}$ are matrices, but in the single-input, single-output case of this example, $\bar{y}$, V, and e are scalars. Note that due to the physical definitions of the wall-wetting parameters, both c and $b_v$ are constrained to values between zero and one.

In order to minimize $J(\hat{p})$, take the partial derivative with respect to $\hat{p}$ and set it equal to zero:

$$\frac{\partial J}{\partial \hat{p}} = -h(k)'V^{-1}(\bar{y}(k) - h(k)\hat{p}(k)) + \bar{P}^{-1}(\hat{p}(k) - \hat{p}(k-1)) = 0 \tag{8}$$

Solving for $\hat{p}(k)$ gives:

$$\hat{p}(k)=(h(k)'V^{-1}h(k)+\bar{P}^{-1})^{-1}(h(k)'V^{-1}\bar{y}(k)+\bar{P}^{-1}\hat{p}(k-1)) \tag{9}$$

By definition, the parameter covariance update is then given by:

$$\bar{P}(k+1)=(h(k)'V^{-1}h(k)+\bar{P}(k)^{-1})^{-1} \tag{10}$$

Equations (9) and (10) are the equations which can be solved recursively in order to identify the wall-wetting parameters on a cycle-by-cycle basis. However, it is not desirable to perform the necessary matrix inversions in a conventional engine control. Furthermore, the covariance update tends to bring the covariance down to levels where the system is no longer significantly updating the parameter estimates. Therefore, it was decided that the parameter estimate covariance would be assumed constant and placed at such a level that the estimator would remain 'awake' at all times without providing excessively noisy estimates. It was also noted that the wall-wetting parameters may be assumed to vary independently over the engine's operating range. This physical phenomena corresponds to a diagonal covariance (i.e. there is no cross-correlation between c and $b_v$). Therefore, for the update equations derived here, it is assumed that $$\bar{P} = \begin{bmatrix} 1/P_1 & 0 \\ 0 & 1/P_2 \end{bmatrix} \tag{11}$$

is a constant. This assumption is made because it reflects the observed physical nature of the wall-wetting dynamics. However, the covariance could be assumed to have a different form or be updated on line without departing from the essential teaching of this embodiment. Substituting Equation (11) into Equation (9) and solving yields:

$$\hat{c}(k) = \hat{c}(k-1) + \frac{P_1(u(k-1)-u(k))*(\bar{y}(k)-h(k)\hat{p}(k-1))}{vP_1P_2 + P_1(u(k-1)-u(k))^2 + P_2(u(k-1)-y(k-1))^2} \tag{12}$$

$$\hat{b}_v(k) = \hat{b}_v(k-1) + \frac{P_2(u(k-1)-y(k-1))*(\bar{y}(k)-h(k)\hat{p}(k-1))}{vP_1P_2 + P_1(u(k-1)-u(k))^2 + P_2(u(k-1)-y(k-1))^2} \tag{13}$$

where:

$$\hat{p}(k)=[\hat{b}_v(k)\hat{c}(k)]'$$

$$\bar{y}(k)=y(k)-y(k-1)+u(k-1)-u(k);$$

and $$h(k)=[(u(k-1)-y(k-1))(u(k-1)-u(k))]$$

and $1/v=V^{-1}$, $P_1$ and $P_2$ are constants and k is the engine cycle index.

Note: $(\bar{y}(k)-h(k)\hat{p}(k-1))$ is the measured value of $\bar{y}(k)$ minus the estimated value of $\bar{y}(k)$ based upon the values of the wall-wetting parameters at the last engine cycle index and the model. This is the prediction error 219 shown earlier in FIG. 2.

These equations (12) and (13) are far simpler to implement in a conventional engine control than those applied in prior art schemes involving nonlinear programming or similar tools that involve Gauss-Newton iterations, search vector norms, and active set methods, and they are also simpler than those used by those schemes that identify transfer function coefficients instead of the actual wall-wetting parameters.

Note that even though the update Equations (12) and (13) were obtained by explicitly solving a Linear Quadratic control problem, similar results could be obtained with other control/optimization methodologies ($H_\infty$, fuzzy logic, etc.). Similar results could also be obtained by assuming a different form for the estimate covariances or by converting the entire problem to the analogous continuous time (vs. discrete time) problem.

Figure 3:
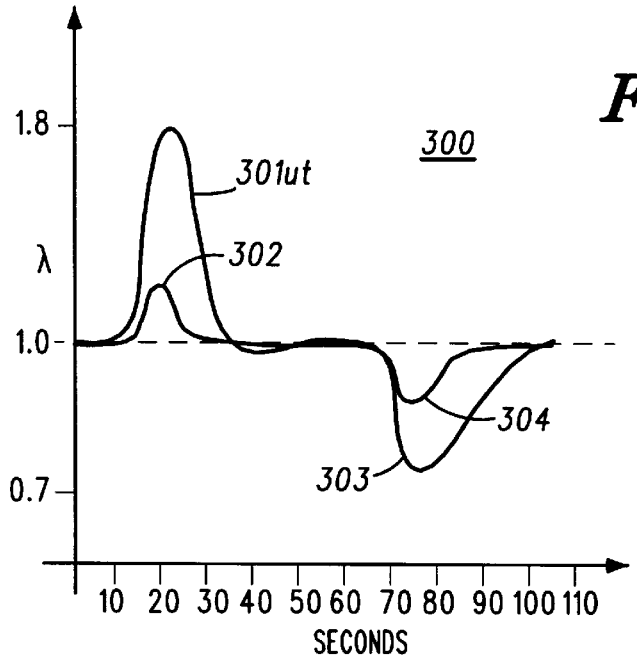
FIG. 3 is a chart illustrating the effect of mapped wall-wetting compensation on transient air/fuel ratio in the presence of engine intake valve deposits vs. the effect of mapped wall-wetting compensation on transient air/fuel ratio for identical throttle transients on the same engine without engine intake valve deposits.

Now that the wall-wetting parameters can be identified on a cycle-by-cycle basis, this information can be used to compensate for the effects of changes in the wall-wetting dynamics over the life of the engine. As mentioned earlier the wall-wetting dynamics will vary due to the effects of engine aging (intake valve deposits), manufacturing variability, fuel volatility variations, and engine operating temperature. These variations make mapped compensators less effective than the adaptive compensators described later in a discussion regarding Compensator Design. FIG. 3 shows the effect of intake valve deposits on non-adaptive air/fuel ratio control.

FIG. 3 is a chart illustrating the effect of mapped wall-wetting compensation on transient air/fuel ratio without engine intake valve deposits vs. the effect of mapped wall-wetting compensation on transient air/fuel ratio for identical throttle transients on the same engine in the presence of engine intake valve deposits. The air/fuel ratio responses depicted in FIG. 3 are characteristic of a steady-state engine operating condition, followed by a rapid transient to a new steady-state engine operating condition, followed by a rapid transient to a new steady-state engine operating condition. The small lean excursion 302 in FIG. 3 is characteristic of the mapped wall-wetting compensator for a throttle transient without engine intake valve deposits being present and with the mapped compensator being properly tuned. The nature of the well-tuned air-fuel ratio control is evidenced by the low peak excursion and the rapid return to a stoichiometric air/fuel mixture. The large lean excursion occurring during the acceleration transient 301 is characteristic of a poorly tuned mapped compensator, which can be caused by engine intake valve deposits. For an engine transient in the presence of engine intake valve deposits, the mapped compensator assumes that far less fuel will be deposited in the puddle than is actually the case. This results in an insufficient amount of fuel being injected into the intake port, resulting in a large lean excursion during the acceleration transient. The much larger peak excursion and much longer time to return to a stoichiometric air/fuel mixture show the degraded performance of the mapped compensator in the presence of intake valve deposits. Similar results hold for a sudden decrease in throttle opening 304 (mapped compensator without engine intake valve deposits and) 303 (mapped compensator with engine intake valve deposits). The wall-wetting dynamic effects caused by the rapid throttle closing are inadequately compensated by the mapped compensator in the presence of engine intake valve deposits. The degraded air/fuel control evidenced by large excursions away from stoichiometry directly results in increased automotive emissions.

The changes in the fuel dynamics caused by intake valve deposits make the mapped compensator less accurate in maintaining a stoichiometric air/fuel ratio in the combustion chamber by rendering the mapped wall-wetting compensation parameters incorrect, resulting in a poorly tuned wall-wetting compensator, which leads to higher emissions. The parameter adaptation algorithm just described identifies these changes on line and on a cycle-by-cycle basis, making accurate compensation for these effects possible. This ability is of paramount importance, as the new emissions regulations have extended emissions control durability requirements to 100,000 miles.

System Hardware Platform

Figure 4:
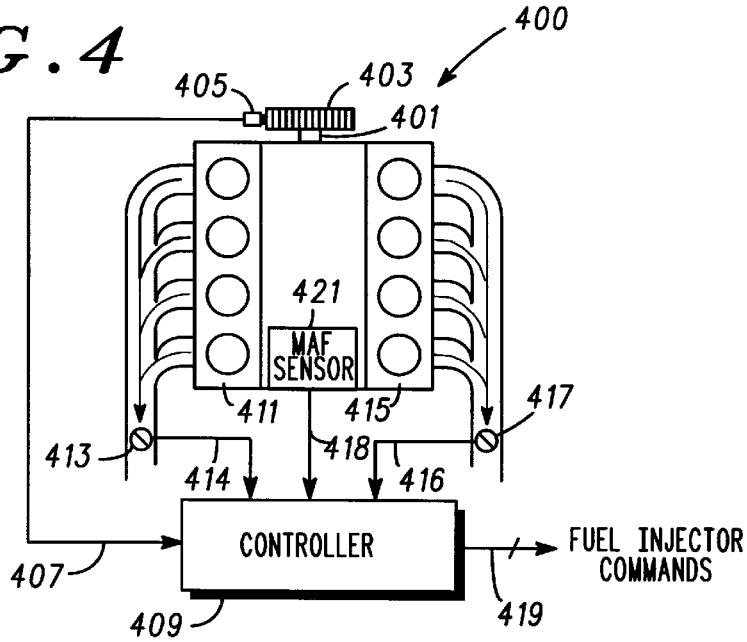
FIG. 4 is a schematic diagram of a system hardware platform.

FIG. 4 is a schematic diagram of a system hardware platform for executing the preferred method steps. The system includes an engine 400 coupled to a crankshaft 401, coupled to a flywheel 403, which provides engine absolute position information 407 via an encoder 405. This engine absolute position information 407 is used by a controller 409 for synchronization of the preferred method. The controller is preferably constructed comprising a Motorola MC68332 microcontroller. The Motorola MC68332 microcontroller is programmed to execute the preferred method steps described later in the attached flow charts. Many other implementations are possible without departing from the essential teaching of this embodiment. For instance another microcontroller could be used. Additionally, a dedicated hardware circuit based control system, controlled in accordance with the teachings of this treatise, could be used for estimating fuel puddle dynamics, and a compensator could be used for adjusting fuel delivery.

Returning to FIG. 4, the engine 400 includes a first cylinder bank 411, which through an exhaust manifold, drives a first UEGO sensor 413. The first UEGO sensor 413 is positioned downstream from the exhaust ports of the first cylinder bank 411 and measures a concentration of oxygen output from each of the cylinders. The first UEGO sensor 413 provides a linear signal 414 having a magnitude dependent on the measured fuel/air equivalence ratio to the controller 409. A second cylinder bank 415 has a complimentary UEGO sensor 417 positioned downstream from the exhaust ports of the second bank of cylinders. This second UEGO sensor 417 also provides a signal indicative of fuel/air equivalence ratio in the exhaust stream due to the exhausting cylinders in the second cylinder bank 415, to the controller 409. Also, the engine 400 has an air-mass flowrate (MAF) sensor 421 coupled to an intake manifold of the engine 400. The air mass flowrate sensor 421 provides an output signal 418 indicative of air mass flow rate into the engine's intake manifold, to the controller 409. Note that as alternative to employing a MAF sensor, a speed-density approach to determining intake air mass charge could be implemented. This type of approach would use an intake air charge sensor—such as an absolute pressure sensor to measure intake manifold pressure, and an engine speed sensor for determining engine speed. An intake mass flow rate or factor can then be calculated dependent on the determined engine speed and the intake manifold pressure.

The controller 409 has a bank of output signals 419 which are individually fed to fuel injectors associated with each cylinder in the first and second cylinder banks 411 and 415.

As described earlier the first and second UEGO sensor signals 414 and 416, the intake manifold mass air flow signal 418 and a stored value of the injected fuel charge commanded by the controller (internal to the controller 409), are used to implement the preferred method.

Signal Processing/Persistent Excitation

Figure 5:
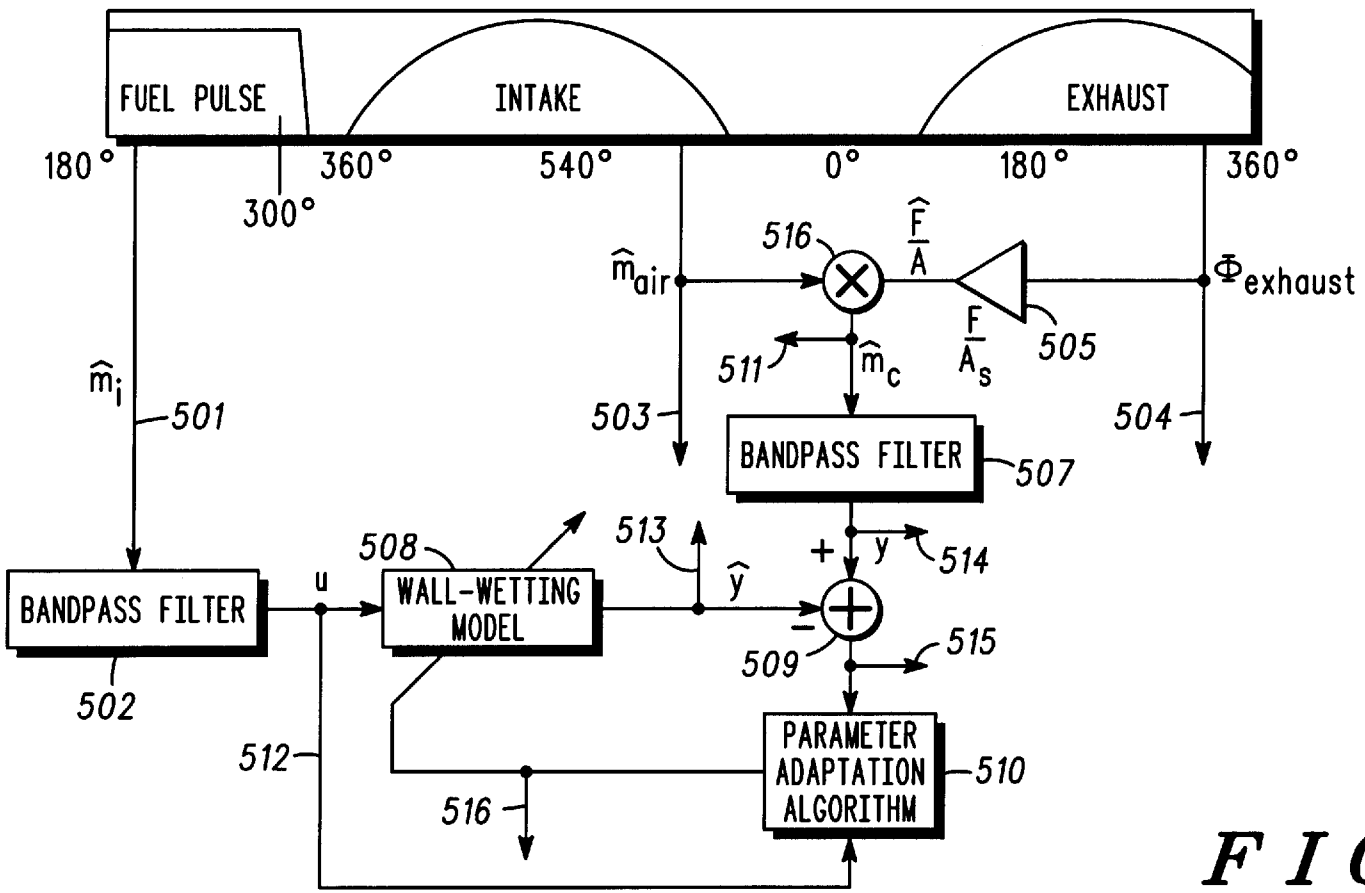
FIG. 5 is a schematic diagram showing a scheduling plan for construction of adaptation signals in accordance with the preferred embodiment of the invention.

Since the parameter adaptation algorithm described in the previous section operates on fuel mass values, it requires an injector command, a UEGO sensor reading, and an air charge estimate per cylinder bank per engine cycle. The input signals are bandpass filtered to minimize effects of sensor noise and system bias on the parameter estimates. The required signals are sampled in accordance with a schedule shown in FIG. 5 to synchronize signal sampling with fuel injection, air intake, and exhaust events for one cylinder per bank. FIG. 5 is a schematic diagram showing a scheduling plan for construction of adaptation signals in accordance with the preferred embodiment of the invention. All angular positions for a given cylinder are expressed with respect to top dead center of the compression stroke for that particular cylinder, which is assigned a value of zero.

Three quantities must be sampled per cylinder event: the mass of fuel injected 501, the charge air mass 503, and the normalized exhaust fuel/air equivalence ratio 504. The mass of fuel injected 501 is sampled whenever the value of the fuel injector pulse width is finalized, just before the start of injection. This signal is then passed through a bandpass filter 502 in order to remove high frequency noise and low frequency bias. The charge air mass 503 is calculated at the bottom of the intake stroke. The normalized exhaust fuel/air ratio 504 is determined from a UEGO signal after the exhaust pulse from the monitored cylinder and just prior to the next exhaust event for that bank, giving the sensor the maximum allowable settling time and thereby minimizing the effects of sensor dynamics on the normalized exhaust fuel/air ratio reading 504. The normalized exhaust fuel/air ratio 504 is then multiplied by the stoichiometric fuel/air ratio 505 and then multiplied by the charge air mass 516 to obtain the raw fuel burned 511 for the just completed cylinder event. The raw fuel burned signal 511 is then passed to a bandpass filter 507 in order to remove high frequency noise and low frequency bias. The filtered fuel injected 512 is then passed to the wall-wetting model 508 to obtain an estimated filtered fuel burned 513. The estimated filtered fuel burned 513 and the filtered measured fuel burned 514 are then used 509 to obtain a prediction error 515, which is then passed to the parameter adaptation algorithm 510. The parameter adaptation algorithm 510 updates the estimates of the wall-wetting parameters 516 consistent with the preferred embodiment of the invention as detailed in Equation (12) and Equation (13) described previously. The updated parameter estimates 516 are then passed to the wall-wetting model 508 for use during the next cycle.

Note that the various signal sampling occurs at constant crankshaft angles synchronous with the engine cycle processes. This greatly simplifies both the identification algorithm and the compensator structure. Due to computational constraints, wall-wetting parameters were assumed constant over a bank of cylinders, and are hence calculated from measurements of one cylinder on each cylinder bank once per cycle. If more processing power were available, this system could operate on all cylinders individually. The two UEGO sensors 413 and 417 are sampled at the indicated engine crankshaft angles because this allows the two UEGO sensors 413 and 417 a maximum possible settling time before sampling, yet before the sensor is exposed to an exhaust pulse from a next cylinder in the firing order. This minimizes the effect of the UEGO sensor dynamics on the resulting signal estimates.

Many adaptation/identification schemes rely on an additional injected excitation on the throttle position (i.e. air flow) and the fuel pulse width (i.e. mass fuel injected) in order to completely excite the dynamics of interest (i.e. to provide 'persistent excitation'). This option may not be necessary for this system, as normal fluctuations in the air charge and throttle input appear to provide all of the excitation necessary for identification provided, of course, that the measurements are sufficiently accurate and have adequate signal to noise ratio. However, tests were run with varying levels of additional broadband excitation signals (a low amplitude pseudo random binary signal with a broadband frequency content was added 613 to the compensated fuel injected 605 (which results in a signal 606), which did indicate that the adaptive control system response may vary during rapid transients, depending upon whether or not the excitation signal was present. Emissions testing will be used to determine whether or not the additional excitation signal will be required to achieve the best results. Finally, it should be noted that the parameter estimates are low pass filtered in order to guarantee that the fuel compensation is smooth and well behaved. It should further be noted that at no time is a fuel puddle mass calculated, distinguishing this method from others proposed in the literature. This significantly reduces the amount of bookkeeping in the real time calculations.

Compensator Design

Figure 6:
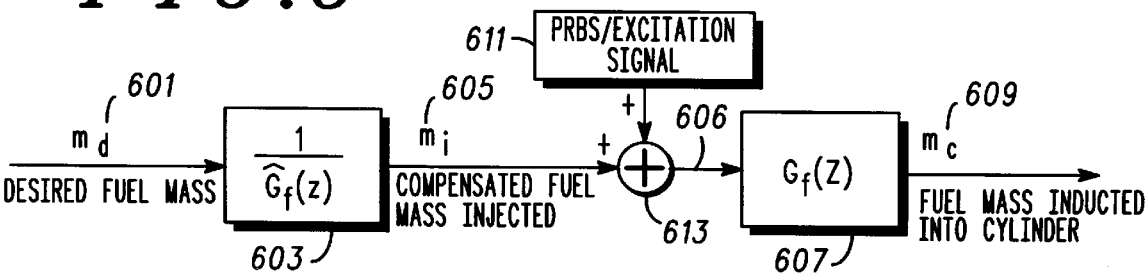
FIG. 6 is a schematic diagram illustrating wall-wetting compensation.

The goal of the compensator is to modify the fuel injected so as to cancel the effects of wall-wetting so that the desired fuel/air ratio is achieved within the cylinders. Schematically, this is shown in FIG. 6. FIG. 6 is a schematic diagram illustrating wall-wetting compensation. The desired fuel mass for combustion 601 in FIG. 6 is passed to a wall-wetting compensator 603. The wall-wetting compensator 603 is the dynamic inverse of the wall-wetting dynamics 607. The wall-wetting compensator 603, modifies the desired fuel mass for combustion 601 to obtain the compensated fuel mass to be injected 605. If desired, a pseudo-random binary signal or other perturbation signal 611 can be added 613 to the compensated fuel mass injected if signal to noise quality is unacceptable or the level of persistent excitation requires augmentation. The compensated fuel mass to be injected 605 is then injected and the engine wall-wetting dynamics 607 modify the fuel mass injected 605 to produce the fuel mass inducted into the cylinder 609. If the inverse wall-wetting dynamics compensator 603 is the exact dynamic inverse of the true wall-wetting dynamics 607, then the sequential application of the inverted 603 and non-inverted 607 wall-wetting dynamics results in a system of unity gain, and the fuel mass inducted into the cylinder 609 will be equal to the desired fuel mass for stoichiometric combustion 601.

Ideally, effective wall-wetting compensation could be achieved by identifying the wall-wetting parameters thereby identifying an estimate of the fuel film transfer function $\hat{G}_f(Z)$, inverting Equation (1) to obtain the inverse transfer function, $$\frac{1}{\hat{G}_f(z)},$$

and using this inverse transfer function to modify the desired fuel quantity. As shown in FIG. 6, the resulting transfer function of the compensator in cascade with the wall-wetting dynamics, $$\frac{G_f(z)}{\hat{G}_f(z)},$$

should approach 1, where the fuel mass inducted into the cylinder perfectly tracks the fuel mass desired, without dynamic distortion. For this case, with the discrete process described by Equation (1), $$\hat{G}_f(z) = \frac{b_0 + b_1 z^{-1}}{1 - a_1 z^{-1}} \tag{14}$$

where we have lumped parameters for convenience;

$$b_0 = (1-c)$$
$$b_1 = (b_v + c - 1) \tag{15}$$
$$a_1 = (1 - b_v)$$

the compensation transfer function is $$\frac{m_i(z)}{m_d(z)} = \frac{1}{\hat{G}_f(z)} = \frac{1 - a_1 z^{-1}}{b_0 + b_1 z^{-1}}. \tag{16}$$

This implies the following difference equation (by taking the inverse Z transform).

$$m_i(k) = \frac{1}{b_0} \times [m_d(k) - a_1 m_d(k-1) - b_1 m_i(k-1)]. \tag{17}$$

This is the compensation equation which is executed every cycle for every cylinder to calculate the amount of fuel to inject. The coefficients are calculated directly from the identified parameters from Equations (15). This is the compensator tuning adaptation mechanism.

However, the wall-wetting dynamics are not always directly invertible. The zero of the transfer function given by Equation (1) is obtained by setting the numerator equal to zero and solving for z:

$$z^*(k) = \frac{b_v(k) + c(k) - 1}{c(k) - 1}. \tag{18}$$

In order for the inverted transfer function, $$\frac{1}{\hat{G}_f(z)},$$

to be stable at a given cycle index k, z*(k) must lie within the unit circle. It is obvious from Equation (18) that as c→1, this will not be the case as the value of z*(k) will approach minus infinity. Physically, as C→1 the entire mass of fuel injected enters the puddle, and the system will hence have a pure delay from the fuel injected to the fuel burned. Therefore, it will not be possible to make a direct correction to the fuel mass on the current cycle. However, if the value of c(k) is lower and z*(k) lies within the unit circle, then direct inversion is possible and current cycle corrections can be made. This problem has not been addressed by prior art. In fact some prior art systems become unstable as the wall-wetting fraction (often called X in prior art) approaches 1. Since the wall-wetting dynamics are characterized by two distinct types of behavior, one system with direct feedthrough of injected fuel and one without direct feedthrough, it was decided to use two separate compensators, one for each condition, with the compensator used on a particular cycle depending on the identified values of c(k) and z*(k). This allows for the best realizable fuel/air ratio control by allowing the compensator to take maximum advantage of the physical nature of the system while also taking care to insure system stability.

Compensator with Direct Feedthrough

In order to provide for conservative and physically understandable bounds on the switch points between the two compensators, it was decided to use the compensator for use with direct feedthrough whenever c(k) is less than 0.9 and z*(k) is greater than 0.08. If c(k) is less than 0.9, a significant amount of direct feedthrough from fuel injected to fuel burned is present in the same engine cycle. By dynamic inversion of the plant model to form a compensator which then cancels the poles and zeroes of the plant, the plant zero, z*(k), becomes the pole of the compensator. The lower limit of 0.08 was selected to reflect the maximum desired bandwidth (frequency) of the compensator. Although pole placement for $-1<z^*(k)<0.08$ would technically be stable, it was not desirable to produce lightly damped oscillatory eigenvalues at high frequencies since this would make the system unnecessarily buzzy. This wall-wetting compensator for use with direct feedthrough is shown in block diagram form in FIG. 7.

Figure 7:
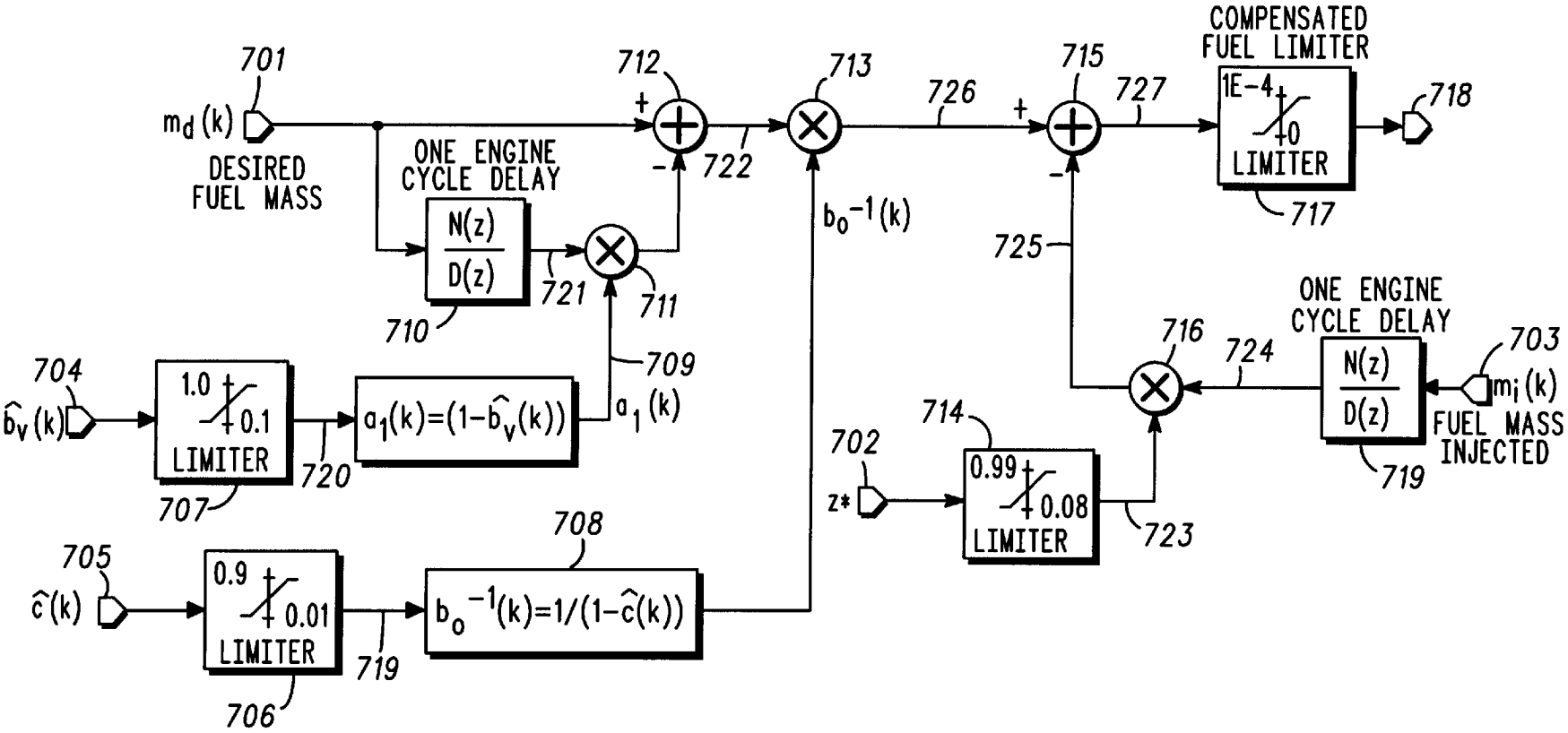
FIG. 7 is a schematic diagram showing a wall-wetting compensator with direct feedthrough.

FIG. 7 is a schematic diagram showing a wall-wetting compensator for an engine operating condition with direct feedthrough. The inputs to the compensator are the desired fuel mass 701, the estimated system zero 702, the injected fuel mass 703, the estimate of a wall-wetting parameter $b_v(k)$ 704 and the estimate of a wall-wetting parameter c(k) 705. The estimate 705 of a wall-wetting parameter c(k) is then passed through a limiter 706. The output of the c(k) limiter 719 is then used to calculate the inverse of $b_0(k)$ 708 in FIG. 7 (see Equation 15). The estimate 704 of a wall-wetting parameter $b_v$ (k) is then passed to a limiter 707. The output 720 of the $b_v(k)$ limiter 707 is then used to calculate $a_1(k)$ 709 in FIG. 7 (see Equation 15). The desired fuel mass for the previous cycle 721, which is the output 721 of a one engine cycle delay 710 is multiplied 711 by $a_1(k)$ 709 and subtracted 712 from the desired fuel mass for the current cycle 701. This signal 722 is then multiplied 713 by the inverse of $b_0(k)$ 708 to obtain the signal 726. The estimated zero for the current cycle 702 is passed through a limiter 714 to obtain a limited estimated zero 723. The fuel mass injected 703 is passed to a one engine cycle delay 719. The output 724 of the delay 719 is then multiplied 716 by the limited estimated zero 723. This signal 725 is then subtracted 715 from the signal 726 to obtain the compensated fuel mass 727. The compensated fuel mass 727 is passed through a limiter 717 to obtain the final value for the compensated fuel mass 718. This is the mass of fuel which must be injected to compensate for the effects of wall-wetting such that the amount of fuel inducted into the cylinder matches the desired fuel mass for stoichiometric combustion. The compensator is a direct form I realization of Equation (17). The compensator performs a pole zero cancellation and modifies the fuel injected so as to compensate for the effects of wall-wetting. Since the wall-wetting dynamics are a low-(frequency)-pass system, the compensator can be described as a lead compensator. Note that the input to the compensator is the desired fuel mass, which is a calculated, and not a sensed, value.

Compensator without Direct Feedthrough

For the case where more than 90% of the fuel injected adheres to the walls of the intake manifold, or whenever the system is not directly invertible, wall-wetting compensation is accomplished by a compensator which assumes that there is no direct feedthrough of fuel into the cylinder during an injection. The system pole in this case is placed at zero, which results in a finite settling time, or deadbeat controller. This compensator is derived in a similar manner to Equation (17), when c=1 is substituted into Equation (15). In order to make the inverted dynamics realizable, it is necessary to use $$z^{-1} \times \frac{1}{G_f(z)}$$

as the compensator transfer function. This introduces a compensator pole at Z=0. This controller attempts to equilibrate the fuel puddle mass at its new equilibrium value by injecting or removing the proper amount of fuel during the current injection cycle, thereby achieving the desired fuel for combustion on the next engine cycle (see FIG. 8). When this compensator performs as intended $m_c(k+1)=m_d(k)$. For transient fuel control this compensator provides the most rapid compensation possible given the physical constraints present. The compensation difference equation is:

$$m_i(k) = \frac{1}{b_1} \times [m_d(k) - a_1 m_d(k-1)].$$

Figure 8:
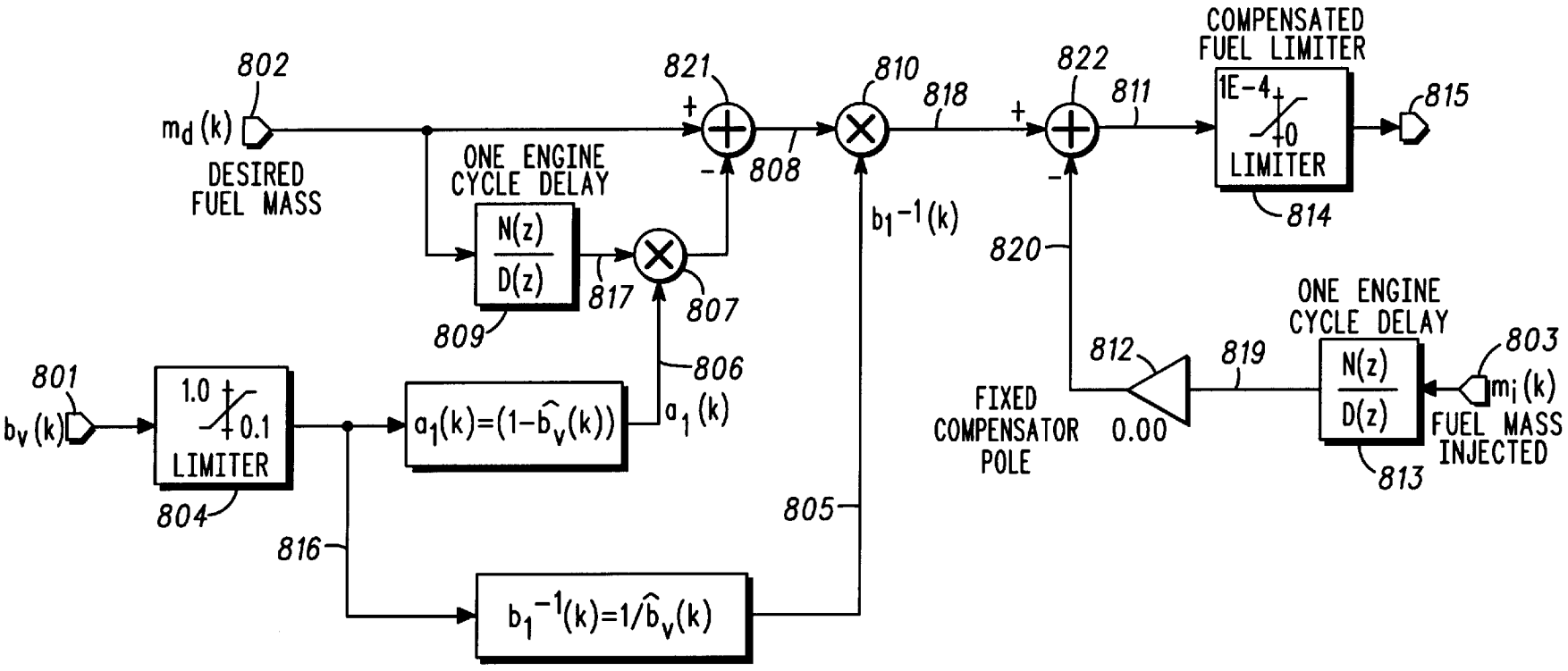
FIG. 8 is a schematic diagram illustrating a wall-wetting compensator without direct feedthrough.

FIG. 8 is a schematic diagram illustrating a wall-wetting compensator for an engine operating condition without direct feedthrough. The inputs to the compensator are the desired fuel mass 802, the injected fuel mass 803, and the estimate 801 of a wall-wetting parameter $b_v(k)$. The estimate 801 of a wall-wetting parameter $b_v(k)$ is then passed through a limiter 804 to obtain a limited estimate 816 of $b_v(k)$. The limited estimate 816 of $b_v(k)$ is then used to calculate $a_1(k)$ 806 in FIG. 8, see Equation (15) and $b_1(k)$ 805 in FIG. 8, see Equation (15), assuming that there is zero direct feedthrough of fuel from the injection to the fuel mass inducted into the cylinder. The desired fuel mass 802 is passed to a one engine cycle delay 809. The delayed desired fuel mass 817 is multiplied 807 by $a_1(k)$ 806 and subtracted 821 from the desired fuel mass for the current cycle 802. This signal 808 is then multiplied by the inverse of $b_1(k)$ 805 to obtain the signal 818. The fuel mass injected 803 is passed to a one engine cycle delay 813 to obtain the delayed injected fuel mass 819. The delayed injected fuel mass 819 is multiplied by the fixed compensator pole 812 to obtain the signal 820. The signal 820 is then subtracted 822 from the signal 818 to obtain the compensated fuel mass 811. The compensated fuel mass 811 is passed through a limiter 814 to obtain the final value for the compensated fuel mass 815.

Figure 9:
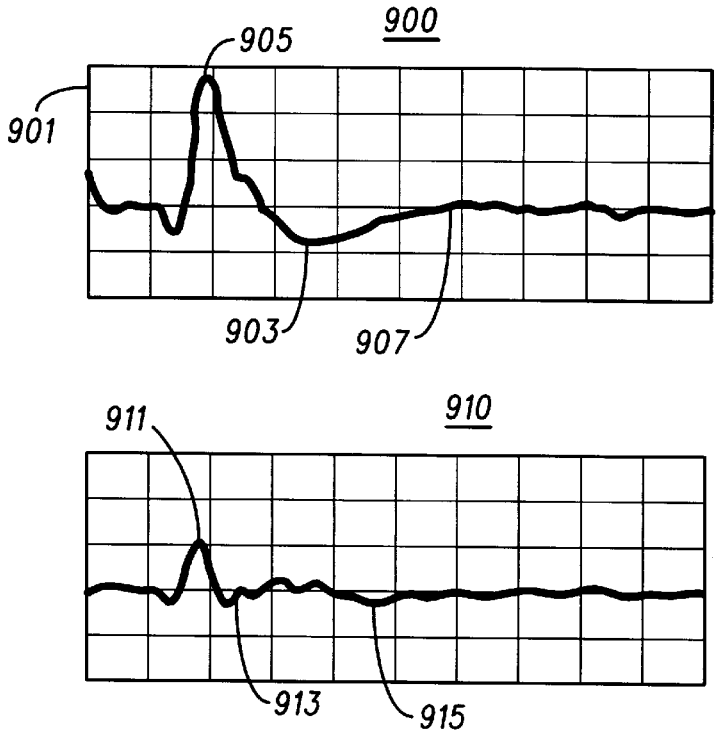
FIG. 9 is a chart illustrating an air/fuel mixture exhausted resulting from a conventional mapped controller and an air/fuel mixture exhausted resulting from the adaptive wall-wetting compensator method described herein.

FIG. 9 includes a pair of charts with identical scaling which demonstrate the effect of mapped wall-wetting compensation on transient exhausted air/fuel ratio vs. the effect of adaptive wall-wetting compensation on transient exhausted air/fuel ratio for identical throttle transients on the same engine for a cold engine operating condition. In both cases (900 and 910), an engine dynamometer was operated at 1,100 RPM (revolutions per minute) and 30 kPa (kilo Pascals) manifold absolute pressure (MAP), and the engine coolant temperature was maintained at approximately 62 degrees Centigrade, which is below the normal engine coolant temperature for a warm engine. This simulates the operation of an engine in cold operating conditions before the engine is fully warmed up. The dynamometer then changed the MAP to 90 kpa by opening the throttle over five seconds while maintaining engine speed at 1,100 RPM and then maintained this operating condition. The differences in the quality of the control of the air/fuel ratio between the mapped compensator and the adaptive compensator is dramatic. The response of the mapped compensator is shown in chart 900 in FIG. 9. The large lean excursion occurring during the acceleration 905 is characteristic of a poorly tuned mapped compensator, which is caused by the cold engine operating condition. For a cold engine operating condition, the mapped compensator assumes that far less fuel will be deposited in the puddle in the intake manifold than is actually the case, as the wall-wetting parameters in a typical mapped compensator are stored only as functions of MAP and engine RPM. This results in an insufficient amount of fuel being injected into the intake manifold, resulting in a large lean excursion during acceleration. The error driven feedback loop then attempts to correct the lean excursion by injecting larger amounts of fuel, but results in overshoot, causing a rich excursion 903 directly following the lean excursion 905. The system then returns to stoichiometric operation 907.

The response of the adaptive compensator is shown in chart 910 in FIG. 9. The lean excursion 911 resulting from the acceleration with the adaptive compensator is of a much smaller magnitude than the corresponding excursion for the mapped compensator 905. The improved nature of the air-fuel ratio control is evidenced by the much lower peak excursion (905, 911) and the much more rapid return to a stoichiometric air/fuel mixture (907, 915). The rich excursion resulting from the acceleration with the adaptive compensator 913 is much smaller and of a shorter duration than the corresponding excursion with the mapped compensation 903. The adaptive scheme shows a peak lambda reduction of sixty percent and moves lambda back to stoichiometry three times faster when compared to the mapped compensator results. The reduction in excursions in air/fuel ratio away from stoichiometry directly results in decreased automotive emissions.

Testing performed on a warm engine also indicated that the adaptive compensator achieves more effective air/fuel ratio control for typical drive cycle tests than the mapped compensator. This indicates that the adaptive compensator achieves superior performance even for engine operating conditions where the mapped compensator is well calibrated.

The earlier described wall-wetting compensator operates on each cylinder during each firing event by modifying the desired fuel mass for each cylinder so as to compensate for the effects of wall-wetting, and thus provides the proper amount of fuel such that the fuel mass ingested into the cylinder will match the desired fuel mass (see FIG. 6). The wall-wetting parameters are estimated on a cycle by cycle basis once per bank (by assuming that each cylinder in a particular bank is characterized by the wall-wetting dynamics for one particular cylinder in that bank). The parameter estimation is performed once per bank in order to reduce computational requirements. If more processing power were available for fuel control, the wall-wetting parameters could be identified for the individual cylinders. The wall-wetting parameter estimates are then used to calculate the appropriate values of the wall-wetting compensator gains. The parameter adaptation algorithm requires the mass fuel injected, the air charge estimate, and the fuel mass burned (which is determined from the UEGO signal and the air charge estimate) for the cylinders which are assumed to be representative of the two engine banks. These are sampled at an optimal engine position for each cylinder under evaluation in accordance with the scheduling plan described in FIG. 5.

All of the routines illustrated in the flow charts described next of FIG. 10 through 14 are encoded into software executed on the Motorola MC68332 microcontroller imbedded into the controller 409 shown in FIG. 4.

Figure 10:
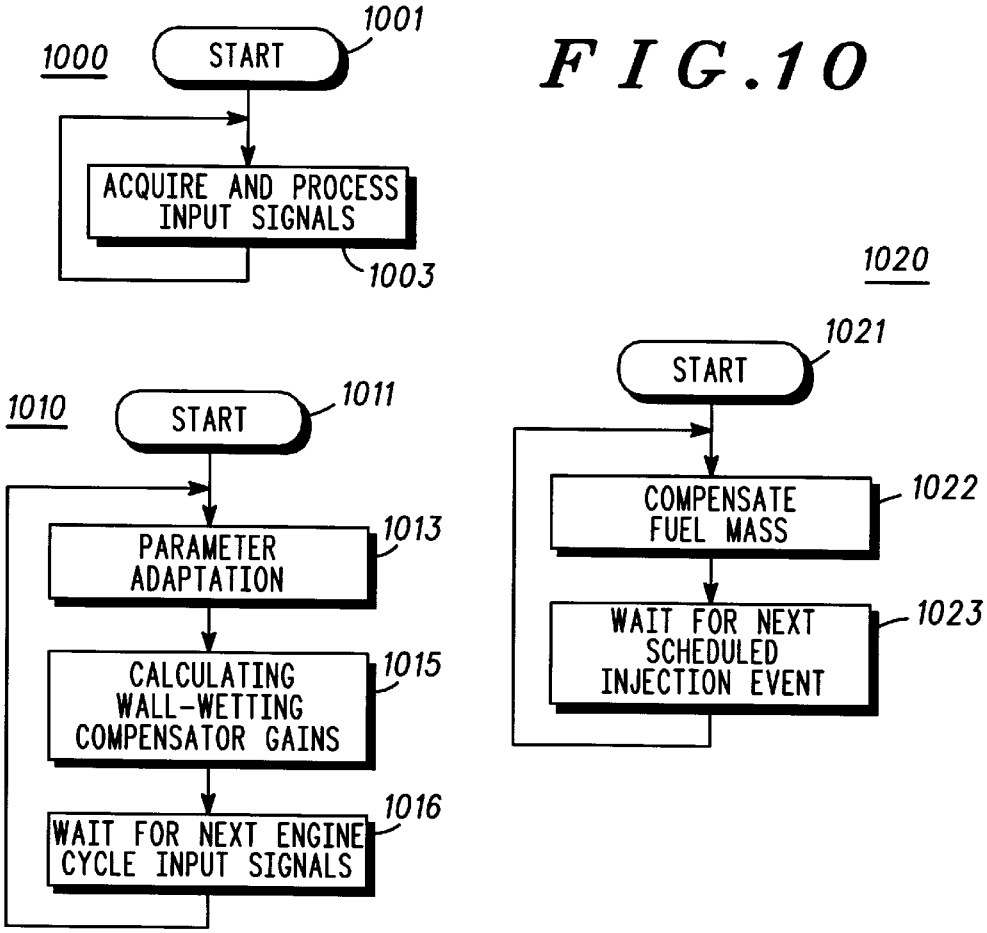
FIG. 10 shows two high level flow charts that are used to implement the preferred method.

FIG. 10 shows three high level flow charts which are used to implement the preferred method.

A first flow chart, routine 1000, operates continuously after start step 1001 is executed. In step 1003 the controller 409 continuously acquires and processes signals indicative of operating parameters of the engine 400. These signals include engine absolute position information measured using the encoder 405, exhaust gas oxygen concentration measured using the first UEGO sensor 413 and the complimentary UEGO sensor 417, air mass flowrate measured using the (MAF) sensor 421. Further details of step 1003 are expanded upon in FIG. 11.

In another routine 1010, a control loop is executed continuously after invocation at a start step 1011. In step 1013 parameter adaptation is performed. Next, in step 1015 the controller gains for a wall-wetting compensator are determined. Next, in step 1016 the control loop waits for the next engine cycle input signals, then routine 1010 iterates.

In another routine 1020, a wall-wetting compensator is executed continuously after invocation at a start step 1021. In step 1022 the engine controller 409 continuously acquires the desired fuel mass 601 for the next cylinder event and determines the amount of fuel to be injected in order to compensate for wall-wetting effects. Next, during step 1023 the routine waits for the next desired fuel mass 601, then routine 1020 iterates. Next, the details of each of the method steps presented in FIG. 10 will be discussed.

Figure 11:
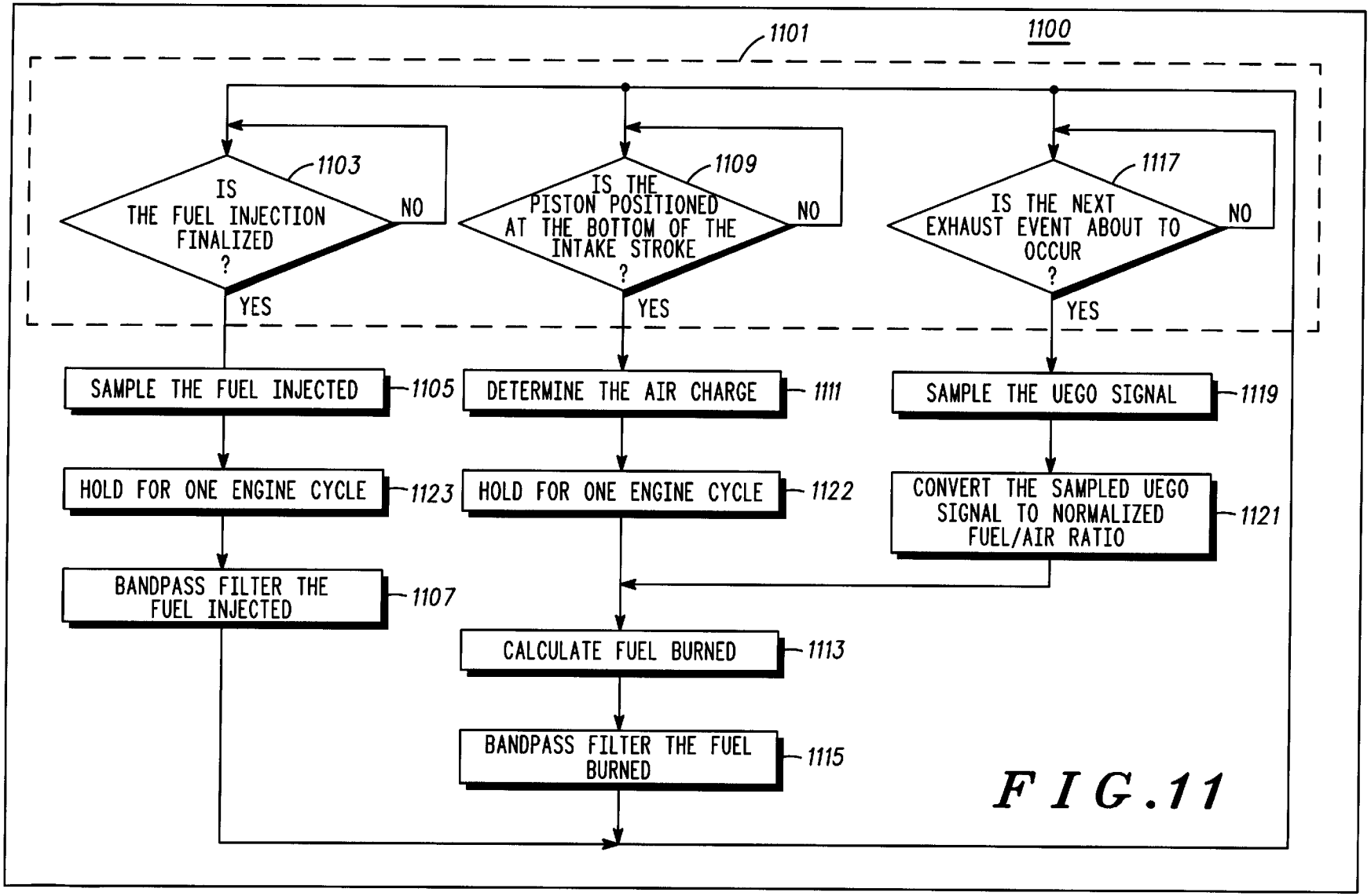
FIG. 11 is a flow chart detailing the continuously operating acquisition and signal processing step shown in FIG. 10.

FIG. 11 is a flow chart detailing the continuously operating acquisition and signal processing step shown at reference number 1003 in FIG. 10.

A routine 1100 is operated continuously, and steps shown within a dashed reference box 101 are invoked via the scheduling plan earlier introduced in FIG. 5. In step 1103 the controller 409 waits until the mass of fuel to be injected is finalized for a particular cylinder under consideration. This instant in time is determined using the engine absolute position information measured using the encoder 405. When the mass of fuel to be injected is finalized for the particular cylinder under consideration, the fuel injected 419 is sampled in step 1105. The fuel injected is then delayed (held) one engine cycle in step 1123 so that the fuel injected, the air charge, and the fuel burned calculated from the UEGO signal are coherent (i.e. all three signals correspond to the same cylinder event).

Next, in step 1107 the fuel injected signal sampled in step 1105 and held one cycle in step 1123 is bandpass filtered. The filter used in the preferred embodiment of this invention requires 3 additions and 4 multiplies per cycle per bank. The fuel injected signal is bandpass filtered in order to remove DC bias (offset) and high frequency noise from the signal, as input bias and high frequency noise can cause the parameter adaptation algorithm to determine incorrect estimates of wall-wetting parameters. Many different types of filters, discrete and analog, with varying cut-off frequencies could be employed without departing from the essential teaching of this embodiment.

Then the routine 1100 returns to the scheduler 1101.

In another step 1109, the scheduler 1101 waits until the piston for the cylinder under evaluation is positioned at the bottom of its intake stroke. When the subject piston is positioned at the bottom of the intake stroke, step 1111 is executed and an air charge is determined for the cylinder under consideration. This is done by reading a signal 418 from the MAF sensor 421. Alternately, the air charge could be determined using a MAP sensor with a table correction, a Kalman Filter, an Extended Kalman Filter, or another estimation algorithm without departing from the essential teaching of this embodiment. The determined air charge is then delayed (held) one engine cycle in step 1122 so that the fuel injected, the air charge, and the fuel burned calculated from the UEGO signal are coherent (i.e. all three signals correspond to the same cylinder event).

Then, in step 1113 the fuel burned is calculated. This is done using the following equation:

$$m_c = \phi_{UEGO} * \left(\frac{F}{A_s}\right) * \hat{m}_{air}.$$

where $\phi_{UEGO}$ is the normalized exhaust fuel/air equivalence ratio determined from the UEGO sensor signal, $$\left(\frac{F}{A_s}\right)$$

is the stoichiometric fuel/air ratio, and $\hat{m}_{air}$ is the estimated mass of the air charge for that particular cylinder event. This brings the total multiplies per cycle per bank to six. Note that the normalized fuel/air ratio acquisition steps will be discussed in detail later. The calculation of the normalized fuel/air ratio is required by other components of the fuel control strategy, and hence does not increase the required number of computations.

Next, in step 1115 the calculated fuel burned is bandpass filtered, and the routine 1100 returns to the scheduler 1101. The calculated fuel burned is bandpass filtered in order to remove dc bias and high frequency noise from the calculated fuel burned, as bias and high frequency noise can cause the parameter adaptation algorithm to determine incorrect estimates of wall-wetting parameters. The filter used in the preferred embodiment of this invention is similar to the filter used in step 1107, which brings the total number of required additional mathematical operations to 6 additions and 10 multiplies. Many different types of filters, discrete and analog, with varying cut-off frequencies could be employed without departing from the essential teaching of this embodiment.

In step 1117 the scheduler waits until the next exhaust event for the cylinder under evaluation is about to occur. When the next exhaust event is about to occur, the UEGO signal is sampled in step 1119. Since the controller 409 via the previously described encoder in the positioning system knows in which cylinder bank the cylinder firing is located, the appropriate UEGO signal sensor either 413 or 417 is sampled and provides the relevant UEGO sensor signal 414 or 416 correspondingly.

Then, in step 1121, the sampled UEGO signal is converted into normalized fuel/air ratio via the UEGO sensor calibration curves, which map the voltage output of the UEGO signal to a unique fuel/air equivalence ratio. Next, steps 1113 and 1115 are executed as described above, and the routine 1100 returns to the scheduler 1101. Next details of the parameter adaptation will be introduced.

Figure 12:
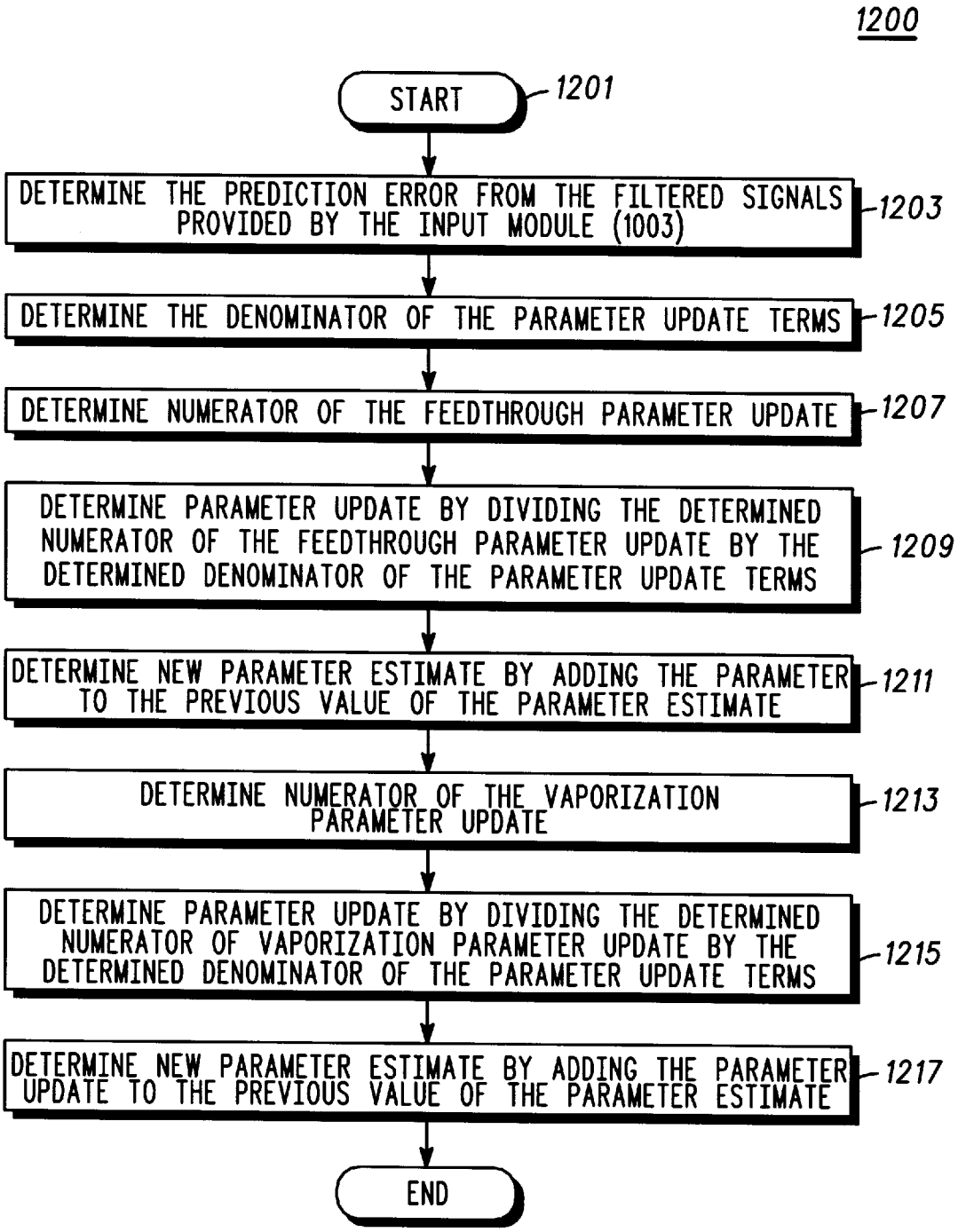
FIG. 12 is a flow chart illustrating the details of the parameter adaptation step introduced in FIG. 10.

FIG. 12 is a flow chart illustrating the details of the parameter adaptation step introduced in FIG. 10.

The routine 1200 commences at a start step 1201. Next, in step 1203 the prediction error is determined from the filtered signals provided by the input module 1000 from FIG. 10. Recall that the system output was rewritten as $\bar{y}(k)$ so as to be linear in the wall-wetting parameters (Equation 5):

$$y(k)-y(k-1)-u(k)+u(k-1)=b_v(u(k-1)-y(k-1))+c(u(k-1)-u(k))' \quad (5)$$

where the cycle-by-cycle dependence of the wall-wetting parameters is now included. The prediction error( $\bar{y}(k)-h(k)\hat{p}(k-1)$) is the measured output $\bar{y}(k)$ for the current cycle minus the value of y(k) expected based on the estimates of the wall-wetting parameters for the previous cycle:

$$(\bar{y}(k)-h(k)\hat{p}(k-1))=y(k)-y(k-1)-u(k)+u(k-1)-(b_v(k-1)(u(k-1)-y(k-1))+c(k-1)(u(k-1)-u(k)))$$

(see Equations (5) and (6)). This process requires 7 additions and 2 multiplies, bringing the total number of required additional mathematical operations to 13 additions and 12 multiplies per cycle per bank.

Then, in step 1205 a denominator of the parameter update terms shown in Equations (12) and (13) is determined by the controller 409. This is the denominator of the right hand terms in Equations (12) and (13). These right hand terms are called the parameter updates because they are added to the estimate of the appropriate wall-wetting parameter for the previous cycle to obtain the estimate of the appropriate wall-wetting parameter for the current cycle. The $vP_1P_2$ term in the denominator can be represented by a single constant if the covariance of the parameter estimates is assumed to be constant. This results in the determination of the denominator requiring only 3 additions and 6 multiplies, bringing the total number of required additional mathematical operations to 16 additions and 18 multiplies per cycle per bank.

In step 1207 a numerator of the feedthrough parameter update Equation (12) is determined. This process involves 1 addition and 2 multiplies per cycle per bank.

Then in step 1209 a parameter update for the feedthrough wall-wetting parameter c(k) is determined by dividing the determined numerator of the feedthrough parameter update by the determined denominator of the parameter update terms.

Then, in step 1211 a new feedthrough parameter estimate is determined by adding the parameter update to the previous value of the feedthrough parameter estimate from the last firing of the cylinder under consideration (see Equation (12)). This step brings the total number of required additional mathematical operations to 18 additions, 20 multiplies, and 1 divide per cycle per bank. Multiplies and divides are accounted for separately as they are calculated quite differently in the microprocessor, with division being much more complicated (and hence much less desirable) than multiplication.

In step 1213 a numerator of the vaporization parameter update is determined.

Then, in step 1215 a vaporization parameter update is determined by dividing the determined numerator of the vaporization parameter update by the determined denominator of the parameter update terms.

Next in step 1217, a new vaporization parameter estimate $b_v(k)$ is determined by adding the parameter update to the previous value of the parameter estimate(associated with the last firing of the current cylinder—see Equation (13)). This step brings the total number of required additional mathematical operations to 20 additions, 22 multiplies, and 2 divides per cycle per bank.

Then, routine 1200 ends.

Figure 13:
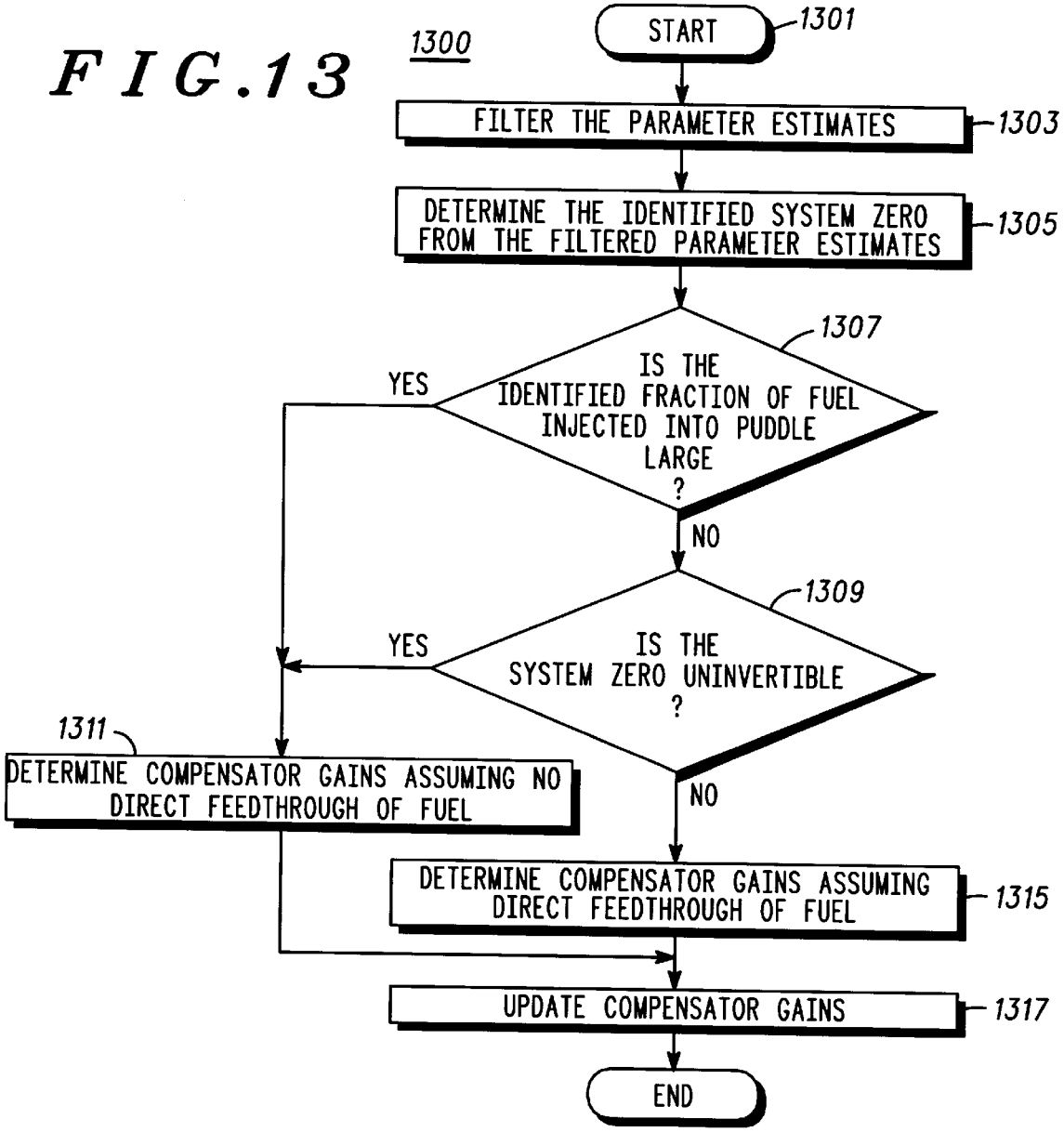
FIG. 13 is a flow chart detailing the calculation of the gains of the wall-wetting compensator introduced in FIG. 10.

FIG. 13 is a flow chart showing details of the calculation of the gains of the wall-wetting compensator introduced in step 1022 of FIG. 10. The calculation of the gains of the wall-wetting compensator was introduced in step 1015 of FIG. 10.

Routine 1300 commences at a start step 1301. In step 1303 the parameter estimates (derived in the parameter adaptation step 1013) are filtered. The filter is a simple first order band pass filter designed to remove high frequency changes in the wall-wetting parameters. The function of the filter is to prevent rapid, high frequency changes in the compensator gains, which could result in erratic fuel compensation. Other filters could be employed, and if desired, this step could be eliminated. As implemented in the preferred embodiment of this invention, filtering the parameter estimates requires an additional 2 additions and 4 multiplies per cycle per bank.

Next, in step 1305 the identified system zero is determined from the filtered parameter estimates (see Equation (18)). This step requires 3 additions and a divide, bringing the total number of required additional mathematical operations to 25 additions, 26 multiplies, and 3 divides per cycle per bank.

Then, in step 1307 a test is made to see whether or not the identified fraction of fuel injected into the puddle is large. If it is, step 1311 is executed.

In step 1311 the compensator gains are determined assuming no direct feedthrough of fuel, which requires 1 additional addition and 1 divide. This means that the compensator inverts the wall-wetting dynamics assuming that the value of the feedthrough wall-wetting parameter c(k) is equal to one. In order to make the inverted dynamics realizable, it is necessary to use $$z^{-1} \times \frac{1}{G_f(z)}$$

as the compensator transfer function. This introduces a compensator pole at Z=0. This controller attempts to equilibrate the fuel puddle mass at its new equilibrium value by injecting or removing the proper amount of fuel during the current injection cycle, thereby achieving the desired fuel for combustion on the next engine cycle (see FIG. 8). When this compensator performs as intended $m_c(k+1)=m_d(k)$. For transient fuel control this compensator provides the most rapid compensation possible given the physical constraints present. Note that the pole could be placed elsewhere if desired, and that the assumed value of the feedthrough term could be changed without departing from the essential teaching of this embodiment.

Once step 1311 is completed, the engine control computer executes step 1317, updating the wall-wetting compensator gains. The routine 1300 then ends.

If the identified fraction of fuel injected into the puddle is not large as determined in step 1307, then step 1309 is executed. In step 1309 the controller 409 checks to see whether or not the system zero is uninvertible. If it is, step 1311 is executed as described above. Although pole placement for $-1<z^*(k)<0.08$ would technically be stable, it was not desirable to produce lightly damped oscillatory eigenvalues at high frequencies since this would make the system unnecessarily buzzy. Therefore, it was decided to define estimated zeros at $-1<z^*(k)<0.08$ as uninvertible for purposes of wall-wetting compensation. This expanded definition of uninvertible could be relaxed or tightened without departing from the essential teaching of this embodiment. If the system zero is not uninvertible, then step 1315 is executed.

In step 1315 the compensator gains are determined assuming direct feedthrough of fuel (this is shown in FIG. 7). This means that the compensator inverts the wall-wetting dynamics directly. This step requires 2 additional additions and 1 divide.

Once step 1315 is completed, the engine control computer executes step 1317, updating the wall-wetting compensator gains. The routine 1300 then ends. The worst case number of required additional mathematical operations is 27 additions, 27 multiplies, and 4 divides per cycle per bank.

Figure 14:
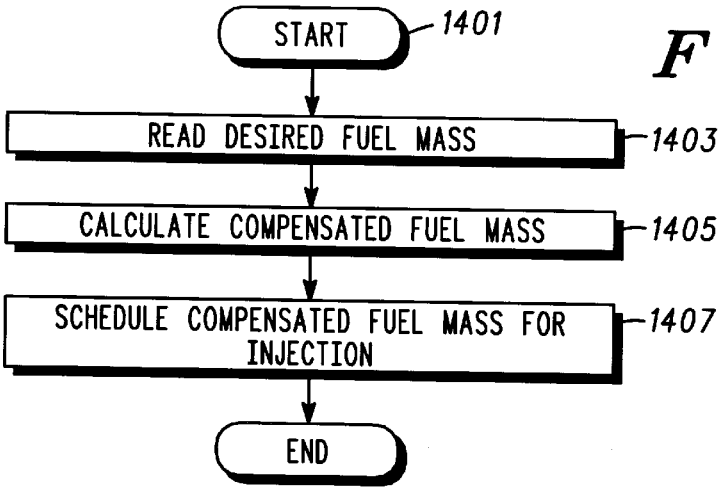
FIG. 14 is a flow chart detailing operation of the wall-wetting compensator introduced in FIG. 10.

FIG. 14 is a flow chart showing details of the operation of the wall-wetting compensator introduced in step 1022 of FIG. 10. Routine 1400 commences at a start step 1401. In step 1403 the desired fuel mass is provided by the engine controller 409.

Next, in step 1405, the desired fuel mass is compensated for wall-wetting effects. The desired fuel mass is compensated by either the compensator which assumes direct feedthrough of fuel (FIG. 7) or the compensator which assumes no direct feedthrough of fuel (see FIG. 8). The details of the selection and operation of the compensators is detailed in the descriptions of FIGS. 7, 8, and 13.

Next, in step 1407, the engine controller 409 schedules the compensated fuel mass for injection into the intake manifold of engine 400. Routine 1400 then ends.

In the worst case, this step 1022 involves 2 additions and 3 multiplies per injection event. These mathematical operations are not included in the totals however, as this is no more than the number required by contemporary fuel control strategies, and is not part of the parameter adaptation process. This means that in order to implement the adaptive wall-wetting compensation method described herein, the number of required additional mathematical operations is 27 additions, 27 multiplies, and 4 divides per engine cycle per bank, in addition to various limiters and logical statements (see FIGS. 7, 8, and 13). This level of required additional computation is extremely modest. Testing has indicated that it is possible to perform this method of adaptive fuel compensation in the production engine controller 409 at engine speeds up to 3000 RPM on a production V-8 engine. This is sufficient, as wall-wetting is no longer a problem at engine speeds above 3000 RPM on this engine. If desired, adaptive fuel compensation could be performed at higher engine speeds if additional processing power were made available. It must also be remembered that the preferred embodiment of the adaptive fuel compensation scheme presented here and its various alternate embodiments replaces a piece of the current fuel control strategy, making the net additional computational cost even lower for most fuel control strategies.

Although the described embodiment offers a significant performance improvement over the prior art solutions there is an alternative embodiment that further improves on the described structure. This alternative embodiment essentially takes into account dynamic changes in engine behavior that occur faster than the one iteration per engine revolution that the above-described embodiment iterates on. These behavioral changes can be caused by a gearshift change, and/or an operator stomping on the vehicle's accelerator pedal, (commonly known as a gorilla stomp). Because the measurement, signal processing, and convergence of the above described adaptation structure may take several engine cycles to converge a faster-responding control structure would be beneficial, where it is possible to take advantage of prior knowledge of functional relationships of the dynamic parameters to measurable variables.

To understand the new structure a little theoretical background would be instructive. First, the parameter adaptation algorithm introduced in EQUATIONs 12 and 13 will be rewritten to include a base term that is a static function of measurable engine variables such as engine speed, engine load, and engine temperature. This enables the parameters to change rapidly as they would be expected to change in response to rapid changes in these variables.

Assuming that:

$\bar{y}(k)$=same as before h(k)=same as before

In the alternative embodiment we define:

$$\hat{p}(k-1)=[b_v(k-1)\hat{c}(k-1)]' \qquad \text{Equation 19}$$

and, $$\hat{b}_v(k)=b_v\text{base}(k)+b_v\text{mod}(k)$$

$$b_v\text{base}(k)=b_v\text{base}(N(k),\text{load}(k),T_c(k))$$

$$b_v\text{mod}(k)=b_v\text{mod}(k-1)+\Delta b_v(k)$$

where:

$b_v$base=a predetermined base function of measured variables $b_v$mod=the adapted parameter, an additive modifier N(k)=engine speed at engine cycle (or time) index k load(k)=an engine load variable like inlet Manifold Absolute Pressure $T_c(k)$=an engine temperature variable like engine coolant temperature The parameter adaptation can now be written in the form:

$$\Delta b_v(k) = \frac{P_2(u(k-1) - y(k-1)) * (\bar{y}(k) - h(k)\hat{p}(k-1))}{vP_1P_2 + P_1(u(k-1) - u(k))^2 + P_2(u(k-1) - y(k-1))^2}$$

By combining EQUATIONS 19 and 20 we get:

$$b_v mod(k) = b_v mod(k-1) + \frac{P_2(u(k-1) - y(k-1)) * (\bar{y}(k) - h(k)\hat{p}(k-1))}{vP_1P_2 + P_1(u(k-1) - u(k))^2 + P_2(u(k-1) - y(k-1))^2} \quad \text{Equation 21}$$

where $\hat{c}(k)$is defined and treated similarly.

Figure 15:
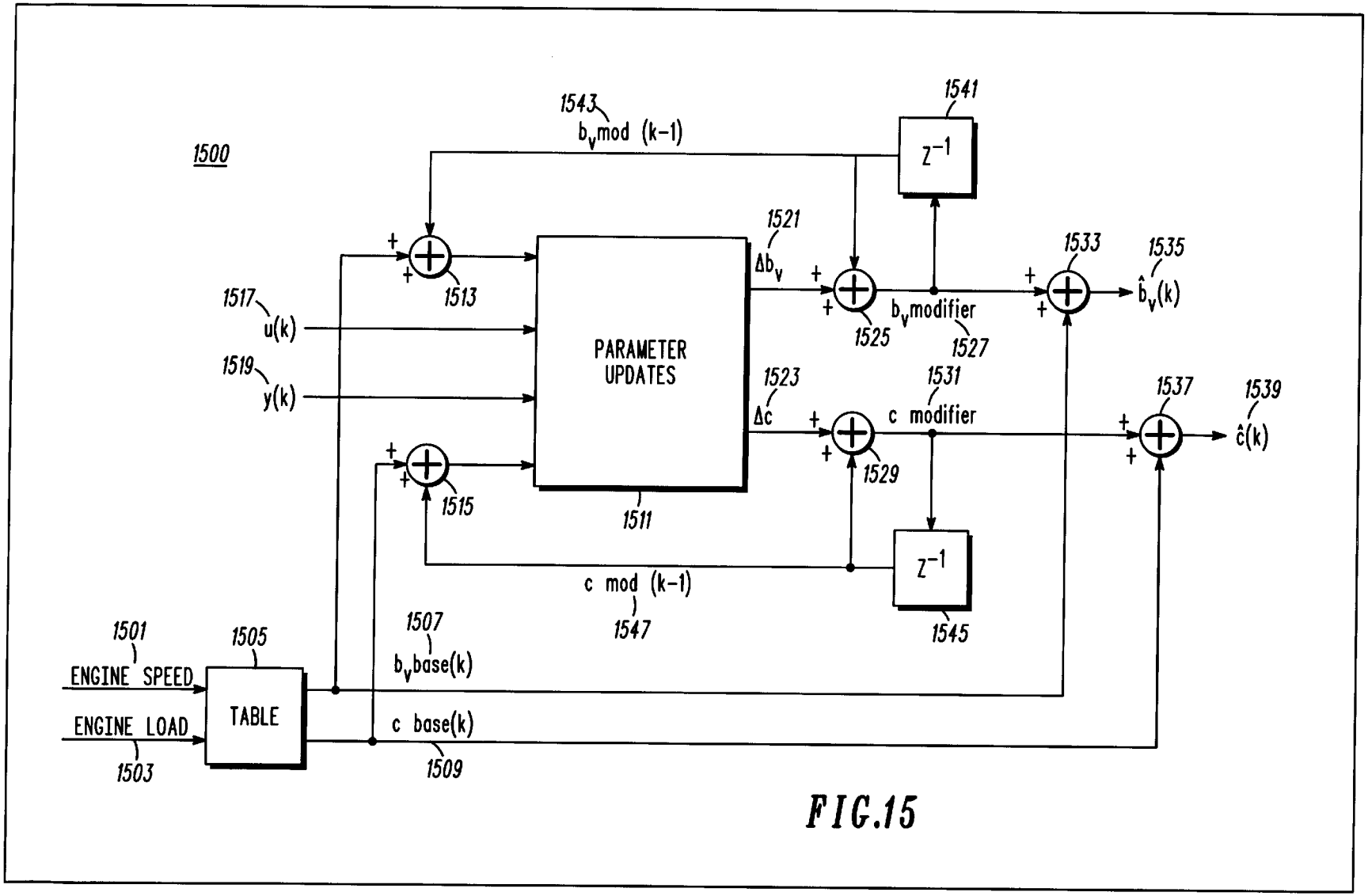
FIG. 15 is a system block diagram showing details of another embodiment of the invention.

FIG. 15 shows a structure 1500 for implementing the base term into the earlier-described parameter adaptation structure. The terms u(k) 1517, and y(k) 1519 are the same as described earlier. These terms u(k) 1517, and y(k) 1519 are fed into the new structure. Element 1511 executes the parameter update equation (EQUATION 21). The engine speed 1501, and engine load 1503 are fed into a table 1505 that transforms, or maps, these measured engine variables engine speed and load into the base term of the parameter update equation (EQUATION 21). This table 1505 is designed based on observations of engine behavior related to engine speed and load. The base term is represented by the variables $b_v$base(k) 1507 and cbase(k) 1509. These terms $b_v$base(k) 1507 and cbase(k) are fed into the parameter update block 1511 through a summation block 1513 and 1515 respectively. Concurrently, these terms $b_v$base(k) 1507 and cbase(k) are fed into summations blocks 1533 and 1537 respectively.

In operation, as the engine runs, the base terms $b_v$base(k) 1507 and cbase(k) 1509 are continually influencing the parameter update operation in block 1511 as well as directly effecting the determined parameter estimates for c and $b_v$(1539 and 1535 respectively). Iteratively, the parameter update block determines $\Delta b_v$ 1521 and $\Delta c$ 1523. These variables $\Delta b_v$ 1521 and $\Delta c$ 1523 are then summed with a prior net accumulation of themselves (the modifier terms), actioned by the unit delay functions 1545 and 1541 respectively. The results are so-called modifiers 1531 and 1527 respectively. Note that the unit delayed modifiers (1547 and 1543 respectively) are summed (1513 and 1515) with the base terms $b_v$base(k) 1507 and cbase(k) 1509 respectively. Finally, the modifiers 1531 and 1527 are summed with the base terms $b_v$base(k) 1507 and cbase(k) 1509 respectively which yields the final parameter estimates 1539 and 1535.

The resultant parameter estimates respond rapidly to rapidly changing engine variables which have a deterministic (predictable) influence such as changes in engine speed, changes in engine inlet manifold pressure (load), and changes in engine operating temperature, while adapting to changes in engine dynamics due to other factors. Given this structure the burden of the adaptation algorithm is reduced since it is no longer is relied upon for large rapid changes that are predictable from the engine state variables. Now the adaptive component becomes a trim adjustment to maintain absolute parameter accuracy with unpredictable parameter variation. Note that although the earlier-described parameter adaptation algorithm was used to describe this embodiment, this embodiment is not limited to its use and can work with other adaptive compensation schemes as well.

Computational Efficiency/Simplicity

One of the major strengths of the compensation method presented here is its simplicity, and hence its modest computational requirements. Adaptive compensation methods proposed elsewhere rely on steady-state engine operation and utilize active set methods with Gauss-Newton searches (Stanford) or nonlinear programming in order to determine the wall-wetting parameters. These algorithms then update tables of parameters, which are used by some sort of compensator. These methods are computationally intensive and use large data sets. Furthermore, many of these methods also identify the air system and sensor dynamics, further complicating the algorithms and increasing the number of required computations. By using a physically meaningful model, solving the recursive LQ problem explicitly, performing the adaptation only once per bank per engine cycle, and sampling the UEGO sensors just before the next exhaust port opens, hence allowing the sensor maximum settling time, the resulting computational requirements for this compensation strategy are drastically lower than competitive schemes. All of the benefits of the adaptive compensators are achieved with only limited computational effort. The total number of required additional mathematical operations is 29 additions, 30 multiplies, and 4 divides per cycle per bank, in addition to various limiters and logical statements (see FIGS. 7, 8, and 13), and this includes all of the signal processing. Furthermore, this algorithm can be implemented without a single calibratable parameter, making this adaptive wall-wetting compensation method an effective, inexpensive alternative to the more complicated and expensive adaptive transient fuel compensation schemes proposed elsewhere. Furthermore, advantages of the alternative embodiment include an ability of the described control system to respond rapidly to rapidly changing engine variables which have a deterministic (predictable) influence such as changes in engine speed, changes in engine inlet manifold pressure (load), and changes in engine operating temperature, while adapting to changes in engine dynamics due to other factors.

In conclusion, the described approach determines wall-wetting parameters on line and cycle-by-cycle, resulting in improved transient and cold engine performance, while the parameter update equations are simple, reducing computational load and simplifying the implementation.

What is claimed is:

1. A method of adaptive transient fuel compensation for a cylinder in a multi-cylinder engine comprising the steps of:

continuously measuring one or more engine parameters of the multi-cylinder engine selected from the group of engine speed, engine load, and engine temperature, and providing a base variable dependent thereon;

estimating fuel puddle dynamics for the cylinder of the multi-cylinder engine by determining parameters of a wall-wetting dynamic model every per engine cycle of the multi-cylinder engine; and combining the base variable and the estimated fuel puddle dynamics and adjusting fuel delivery to the cylinder of the multi-cylinder engine using a lead compensator with adjustable zero tuning and a fixed pole tuning while an estimate of a first wall-wetting parameter is small and a wall-wetting dynamics zero identified dependent on the first and a second wall-wetting parameters is invertible, and adjusting fuel delivery using a lead compensator with adjustable zero tuning and a fixed pole while the estimate of the first wall-wetting parameter is large, and adjusting fuel delivery using a lead compensator with adjustable zero tuning and a fixed pole while a wall-wetting dynamics zero, identified dependent on the first and second wall-wetting parameters, is not invertible.

2. A method of adaptive transient fuel compensation for a cylinder in a multi-cylinder engine comprising the steps of:

measuring one or more engine parameters of the multi-cylinder engine selected from the group of engine speed, engine load, and engine temperature, and providing a base variable dependent thereon;

estimating a first wall-wetting parameter indicative of a fraction of an amount of fuel injected that is retained on surfaces of an intake system for the cylinder of the multi-cylinder engine in accordance with the following relationship:

$$\hat{c}(k) = \hat{c}(k-1) + \frac{P_1(u(k-1)-u(k)) * (\bar{y}(k) - h(k)\hat{p}(k-1))}{vP_1P_2 + P_1(u(k-1)-u(k))^2 + P_2(u(k-1)-y(k-1))^2};$$

estimating a second wall-wetting parameter indicative of a fraction of an amount of fuel vaporized from the surfaces in the intake system for the cylinder of the multi-cylinder engine in accordance with the following relationship:

$$\hat{b}_v(k) = \hat{b}_v(k-1) + \frac{P_2(u(k-1)-y(k-1)) * (\bar{y}(k) - h(k)\hat{p}(k-1))}{vP_1P_2 + P_1(u(k-1)-u(k))^2 + P_2(u(k-1)-y(k-1))^2}; \text{ and}$$

where:

k is an engine cycle index u is a filtered value of fuel injected y is a filtered value of measured fuel burned v is a weighted covariance of exhaust gas sensor measurements $P_1$ is an inverse of a weighted covariance of the estimate of c $P_2$ is an inverse of a weighted covariance of the estimate of $b_v$ $$\hat{p}(k)=[\hat{b}_v(k)\hat{c}(k)]'$$

$$\bar{y}(k)=y(k)-y(k-1)+u(k-1)-u(k);$$

and $$h(k)=[(u(k-1)-y(k-1))(u(k-1)-u(k))]$$

adjusting fuel delivery to the cylinder of the multi-cylinder engine dependent on the provided base variable, the estimated first wall-wetting parameter and the estimated second wall-wetting parameter.

* * * * *